US010935902B2

(12) United States Patent
Kanno et al.

(10) Patent No.: US 10,935,902 B2
(45) Date of Patent: Mar. 2, 2021

(54) TONER

(71) Applicant: CANON KABUSHIKI KAISHA, Tokyo (JP)

(72) Inventors: Ichiro Kanno, Kashiwa (JP); Nozomu Komatsu, Toride (JP); Yuto Onozaki, Saitama (JP); Takakuni Kobori, Toride (JP); Kazuyuki Sakamoto, Noda (JP); Ryo Nakajima, Nagareyama (JP); Hiroyuki Fujikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/701,265

(22) Filed: Dec. 3, 2019

(65) Prior Publication Data

US 2020/0183295 A1 Jun. 11, 2020

(30) Foreign Application Priority Data

Dec. 5, 2018 (JP) ..... 2018-228294

(51) Int. Cl.
*G03G 9/08* (2006.01)
*G03G 9/097* (2006.01)
*G03G 9/087* (2006.01)

(52) U.S. Cl.
CPC ..... *G03G 9/09708* (2013.01); *G03G 9/0825* (2013.01); *G03G 9/08755* (2013.01)

(58) Field of Classification Search
CPC ..... G03G 9/09708; G03G 9/08755; G03G 9/0825
USPC ..... 430/110.1, 109.4, 108.3
See application file for complete search history.

(56) References Cited

U.S. PATENT DOCUMENTS

| | | | |
|---|---|---|---|
| 5,424,810 | A | 6/1995 | Tomiyama et al. |
| 5,464,722 | A | 11/1995 | Tomiyama et al. |
| 5,700,616 | A | 12/1997 | Kasuya et al. |
| 5,712,073 | A | 1/1998 | Katada et al. |
| 5,968,701 | A | 10/1999 | Onuma et al. |
| 5,972,553 | A | 10/1999 | Katada et al. |
| 6,002,895 | A | 12/1999 | Kasuya et al. |
| 6,007,957 | A | 12/1999 | Kobori et al. |

(Continued)

FOREIGN PATENT DOCUMENTS

| | | |
|---|---|---|
| JP | 2006-106727 | 4/2006 |
| JP | 2017-003916 | 1/2017 |
| JP | 2017-003980 | 1/2017 |

OTHER PUBLICATIONS

U.S. Appl. No. 16/686,760, Yuto Onozaki, filed Nov. 18, 2019.

*Primary Examiner* — Mark A Chapman
(74) *Attorney, Agent, or Firm* — Venable LLP

(57) ABSTRACT

A toner including a toner particle that includes a binder resin and a crystalline polyester; and inorganic fine particles on the toner particle surface, wherein a content of the crystalline polyester is 0.5 to 20.0 mass parts per 100 mass parts of the binder resin; in the toner cross section, domains of the crystalline polyester are present in a dispersed state, the percentage for areas of these crystalline polyester domains in the region to a depth of 0.50 μm from a contour of the toner particle is at least 10%, the number average of lengths of a major axis is 120 nm to 1000 nm, and the number average of aspect ratios is not more than 4; a dielectric constant of the inorganic fine particles is 25 to 300 pF/m; and a coverage ratio by the inorganic fine particles on the toner particle surface is 5% to 60%.

10 Claims, 1 Drawing Sheet

(56) References Cited

U.S. PATENT DOCUMENTS

| | | | |
|---|---|---|---|
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 6,905,808 | B2 | 6/2005 | Itakura et al. |
| 7,112,395 | B2 | 9/2006 | Ida et al. |
| 7,147,980 | B2 | 12/2006 | Itakura et al. |
| 7,147,981 | B2 | 12/2006 | Fujikawa et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,361,441 | B2 | 4/2008 | Itakura et al. |
| 7,396,626 | B2 | 7/2008 | Fujikawa et al. |
| 7,396,629 | B2 | 8/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,855,042 | B2 | 12/2010 | Kobori et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,348,253 | B2 | 5/2016 | Kanno et al. |
| 9,372,420 | B2 | 6/2016 | Mizo et al. |
| 9,417,540 | B2 | 8/2016 | Hashimoto et al. |
| 9,500,975 | B2 | 11/2016 | Sugahara et al. |
| 9,594,323 | B2 | 3/2017 | Fujikawa et al. |
| 9,599,920 | B2 | 3/2017 | Sugahara et al. |
| 9,651,883 | B2 | 5/2017 | Hama et al. |
| 9,665,021 | B2 | 5/2017 | Ohtsu et al. |
| 9,665,026 | B2 | 5/2017 | Iwasaki et al. |
| 9,671,707 | B2 | 6/2017 | Minagawa et al. |
| 9,778,598 | B2 | 10/2017 | Onozaki et al. |
| 9,958,809 | B2 | 5/2018 | Sugahara et al. |
| 10,036,970 | B2 | 7/2018 | Kanno et al. |
| 10,082,743 | B2 | 9/2018 | Hama et al. |
| 10,146,146 | B2 | 12/2018 | Komatsu et al. |
| 10,175,595 | B2 | 1/2019 | Onozaki et al. |
| 10,197,936 | B2 | 2/2019 | Onozaki et al. |
| 10,274,851 | B2 | 4/2019 | Hashimoto et al. |
| 10,401,748 | B2 | 9/2019 | Hashimoto et al. |
| 10,451,986 | B2 | 10/2019 | Sano et al. |
| 10,474,049 | B2 | 11/2019 | Onozaki et al. |
| 10,564,560 | B2 | 2/2020 | Onozaki et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0244159 | A1 | 9/2013 | Ishigami et al. |
| 2014/0109820 | A1 | 4/2014 | Kormann |
| 2014/0137428 | A1 | 5/2014 | Takenaka et al. |
| 2014/0329176 | A1 | 11/2014 | Kanno et al. |
| 2018/0259866 | A1* | 9/2018 | Takemori ..... G03G 9/08797 |
| 2018/0314176 | A1 | 11/2018 | Ikeda et al. |
| 2019/0171125 | A1 | 6/2019 | Kanno et al. |
| 2019/0339629 | A1 | 11/2019 | Yamashita et al. |
| 2020/0073263 | A1 | 3/2020 | Hama et al. |

* cited by examiner

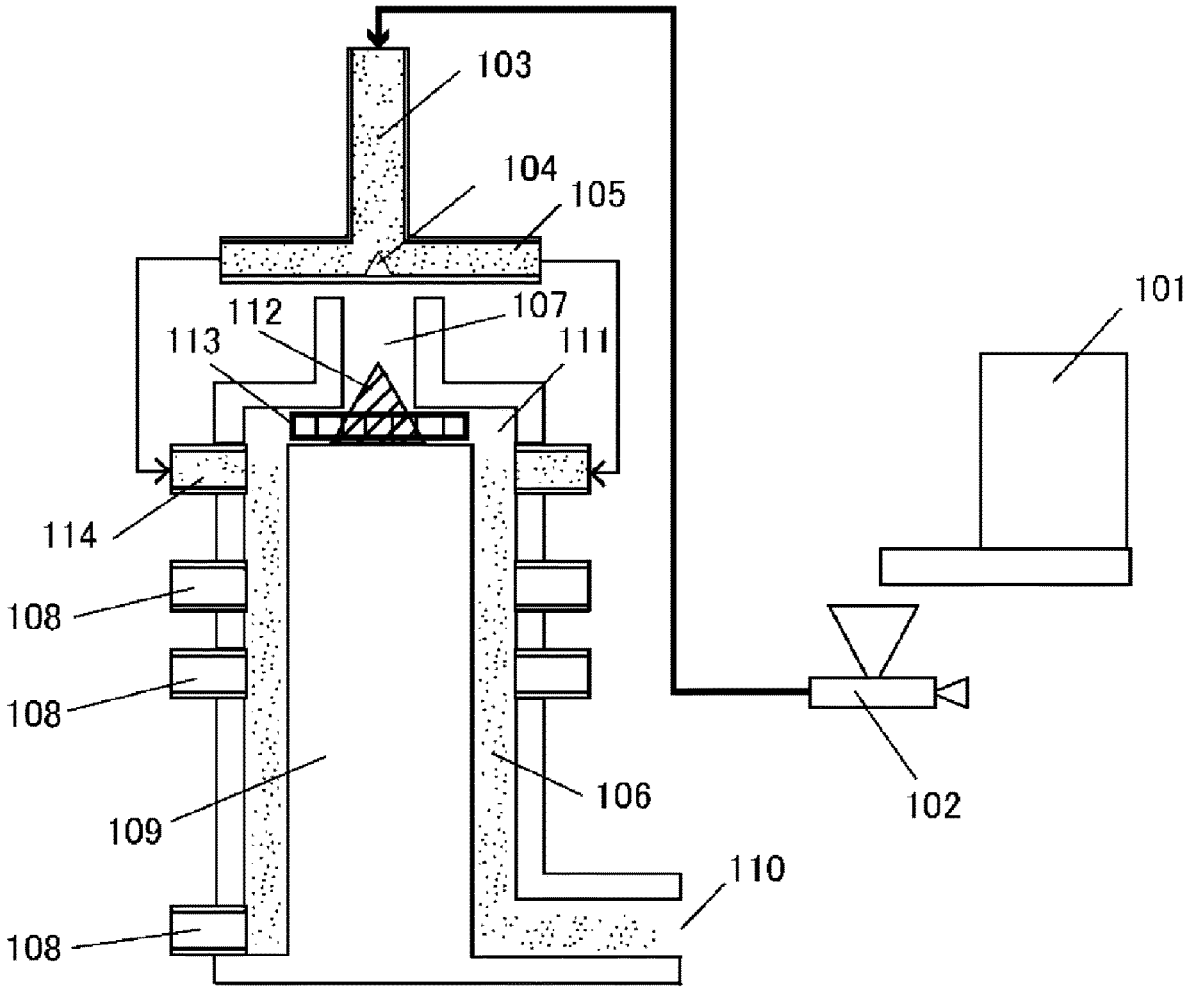
103
104
105
101
112
107
113
111
114
108
108
109
106
102
110
108

TONER

BACKGROUND OF THE INVENTION

Field of the Invention

The present invention relates to the toner used in electrophotographic systems, electrostatic recording systems, and electrostatic printing systems.

Description of the Related Art

Accompanying the extensive spread in recent years of full-color copiers that employ electrophotographic systems, there has been increasing demand for measures that enable and support higher printing speeds and energy conservation. In order to accommodate high-speed printing, investigations have been carried out into art for bringing about a faster melting of the toner during the fixing step. With regard to the response to energy conservation, investigations have been carried out into art for bringing about fixing of the toner at lower temperatures in order to reduce the power consumption during the fixing step.

One method for responding to high-speed printing and improving the low-temperature fixability of toner is to lower the glass transition temperature or softening point of the binder resin in the toner and to use a binder resin that has a sharp melt property. Many toners have been proposed in recent years that include a crystalline polyester resin as a resin having a sharp melt property. However, due to the low viscous stress, release of the printed paper from the fixing member has tended to be problematic with toners having a reduced viscosity.

In order to solve this problem, Japanese Patent Application Laid-open No. 2006-106727 proposes a toner that has a lamellar structure formed by a crystalline polyester component in the vicinity of the toner surface.

In addition, Japanese Patent Application Laid-open No. 2017-003980 proposes a toner in which the state of the dispersion of the crystalline polyester in the toner interior is controlled and the low-temperature fixability has been made to coexist with the stability during durability testing.

Investigations have been carried out into art that solves the aforementioned problem by controlling the state of the dispersion of the crystalline polyester in the toner interior, such as above, and by causing a crystalline polyester or a lubricating material such as a wax to be present in the vicinity of the toner surface.

However, crystalline polyester, on the other hand, has a low electrical resistance, and it is known that toner that includes crystalline polyester tends to have a lower charging performance than toner that does not include crystalline polyester. In order to improve upon this, various investigations have been carried out into art that manipulates the external additives that are used in toners. Japanese Patent Application Laid-open No. 2017-003916 proposes that the charging performance be improved by the addition of strontium titanate fine particles of a prescribed particle diameter to a toner base particle having acicular crystalline polyester domains.

SUMMARY OF THE INVENTION

Investigations by the present inventors have shown that the toners of Japanese Patent Application Laid-open No. 2006-106727 and Japanese Patent Application Laid-open No. 2017-003980 are unsatisfactory in terms of maintaining charge stability in a high-temperature, high-humidity environment.

Moreover, it was found that the toner of Japanese Patent Application Laid-open No. 2017-003916 exhibits an inadequate releasability from paper during fixing and that, in the case in particular of durability testing at a low print percentage in a high-temperature, high-humidity environment and in the case of standing in a high-temperature, high-humidity environment, a reduction in the charging performance for this toner could not be adequately inhibited and tinge variations in the image and fogging in white background regions of the image could not be adequately suppressed as a result.

The present invention provides a toner that solves the aforementioned problems. Specifically, the present invention provides a toner that exhibits charge stability in a high-temperature, high-humidity environment, low-temperature fixability, and releasability during fixing, and that, even after durability testing at a low print percentage, maintains its charging performance and presents little tinge variation and fogging.

The toner comprising:

toner particles, each of the toner particles includes a binder resin and a crystalline polyester; and inorganic fine particles present on a surface of each of the toner particles, wherein a content of the crystalline polyester is from 0.5 mass parts to 20.0 mass parts per 100 mass parts of the binder resin;

in a cross section of each of the toner particles:

(i) the crystalline polyester is observed as domains, (ii) when, in a cross section of each of the toner particles, a sum of areas of all the domains is defined as DA, and a sum of areas of the domains present in a region surrounded by a contour of each of the toner particles and a line apart from the contour by 0.50 μm towards inside of each of the toner particles, is defined as DB, a percentage ratio of DB to DA is 10% or more, and (iii) with respect to the domains present in the region, (iii-a) the number average of lengths of a major axis of the domains is from 120 nm to 1000 nm, and (iii-b) the number average of aspect ratios of the domains is not more than 4;

a dielectric constant of the inorganic fine particles, according to measurement of the dielectric constant at 25° C. and 1 MHz, is from 25 pF/m to 300 pF/m; and a coverage ratio by the inorganic fine particles on the surface of each of the toner particles is from 5% to 60%.

The present invention can thus provide a toner that exhibits charge stability in a high-temperature, high-humidity environment, low-temperature fixability, and releasability during fixing, and that, even after durability testing at a low print percentage, maintains its charging performance and presents little tinge variation and fogging.

Further features of the present invention will become apparent from the following description of exemplary embodiments with reference to the attached drawings.

BRIEF DESCRIPTION OF THE DRAWINGS

The FIGURE is an example of an apparatus for executing a surface heat treatment.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

Embodiments of the present invention are particularly described in the following.

The toner according to the present invention is a toner comprising:

toner particles, each of the toner particles includes a binder resin and a crystalline polyester; and inorganic fine particles present on a surface of each of the toner particles, wherein a content of the crystalline polyester is from 0.5 mass parts to 20.0 mass parts per 100 mass parts of the binder resin;

in a cross section of each of the toner particles:

(i) the crystalline polyester is observed as domains, (ii) when, in a cross section of each of the toner particles, a sum of areas of all the domains is defined as DA, and a sum of areas of the domains present in a region surrounded by a contour of each of the toner particles and a line apart from the contour by 0.50 μm towards inside of each of the toner particles, is defined as DB, a percentage ratio of DB to DA is 10% or more, and (iii) with respect to the domains present in the region, (iii-a) the number average of lengths of a major axis of the domains is from 120 nm to 1000 nm, and (iii-b) the number average of aspect ratios of the domains is not more than 4;

a dielectric constant of the inorganic fine particles, according to measurement of the dielectric constant at 25° C. and 1 MHz, is from 25 pF/m to 300 pF/m; and a coverage ratio by the inorganic fine particles on the surface of each of the toner particles is from 5% to 60%.

By using this toner, an excellent low-temperature fixability and an excellent releasability during fixing are provided, and, even when a low print percentage image with its low toner consumption rate is continuously output in a high-temperature, high-humidity environment, the charging performance of the toner can be maintained at its original excellent level and the image density is stabilized and an image having a reduced tinge fluctuation and reduced fogging can be output.

The present inventors believe the following with regard to the mechanisms for this.

It is thought that, based on its potential difference, the negative charge generated when the toner is stirred in the developing device migrates to the inorganic fine particles on the toner particle surface using the crystalline polyester, which has a relatively low resistance, as a pathway. It is thought that, when the dielectric constant of the inorganic fine particles is in the range indicated above, the inorganic fine particles are present on the toner particle surface in the range indicated above, and the shape of the crystalline polyester domains in the vicinity of the toner particle surface is in the range indicated above, charge does not leak from the toner particle and accumulates at the inorganic fine particles. It is thought that as a result the charging performance is maintained and tinge fluctuations and fogging in white background regions are suppressed even after low print percentage output in a high-temperature, high-humidity environment.

Inorganic Fine Particles

The dielectric constant of the inorganic fine particles must be from 25 pF/m to 300 pF/m in measurement of the dielectric constant at 25° C. and 1 MHz. Known materials can be used without particular limitation as long as the material is an inorganic fine particle having a dielectric constant in the indicated range. In this range, charge accumulation and charge delivery from the crystalline polyester domains can be carried out smoothly and the charge stability of the toner is enhanced.

Viewed from the standpoint of enhancing the charging performance, the dielectric constant of the inorganic fine particles is preferably from 30 pF/m to 100 pF/m and is more preferably from 30 pF/m to 50 pF/m.

The inorganic fine particles can be exemplified by at least one selection from the group consisting of alkaline-earth metal titanate particles such as strontium titanate particles, calcium titanate particles, and magnesium titanate particles and alkali metal titanate particles such as potassium titanate particles.

The inorganic fine particles preferably contain strontium titanate particles and more preferably are strontium titanate particles. Strontium titanate particles have a relatively low resistance and a high dielectric constant and are preferred from the standpoint of the charge stability of the toner.

Among strontium titanate particles, strontium titanate particles having a rectangular parallelepiped particle shape and a perovskite crystal structure are preferred from the standpoint of the charge stability of the toner.

The content in the inorganic fine particles of inorganic fine particles having a rectangular parallelepiped shape is preferably 35 number % to 65 number % and is more preferably 40 number % to 50 number %.

The rectangular parallelepiped particle shape is more preferably a cubic particle shape. This cubic shape and rectangular parallelepiped shape are not limited to a perfect cube or a perfect rectangular parallelepiped and include, for example, an approximate cube and an approximate rectangular parallelepiped in which some corners are missing or corners are rounded. In addition, the aspect ratio of the inorganic fine particles is preferably from 1.0 to 3.0.

Charge injection due to the transfer bias is inhibited while distribution of the charge quantity is sharpened when the volume resistivity of the inorganic fine particles is in the range from $2.00\times10^{9}\Omega\cdot$cm to $2.00\times10^{12}\Omega\cdot$cm, and this is thus more preferred.

The number-average particle diameter of the inorganic fine particles is preferably from 20 nm to 300 nm, more preferably from 30 nm to 100 nm, and still more preferably from 20 nm to 60 nm. The peak top for the numerical frequency in their particle size distribution is preferably in the indicated particle size range. When the number-average particle diameter is in the indicated range, fixation to the toner particle is facilitated, the toner particle can be coated by a small number, and detachment is suppressed, and this serves to facilitate the generation of the effect of an improved charge stability after durability testing with a low print percentage image in a high-temperature, high-humidity environment.

The surface of the inorganic fine particles is preferably hydrophobed with a surface treatment agent. Fatty acids and their metal salts, disilylamine compounds, halogenated silane compounds, silicone oils, silane coupling agents, titanium coupling agents, and so forth are preferred for the surface treatment agent because this can increase the charge stability of the toner. Among the preceding, treatment with n-octylethoxysilane and treatment with 3,3,3-trifluoropropyltrimethoxysilane are preferred from the standpoint of increasing the effect on the charge stability.

The content of the inorganic fine particles in the toner is preferably from 0.1 mass parts to 30.0 mass parts per 100 mass parts of the toner particle. An excellent charge stability is assumed at 0.1 mass parts and above; at 30.0 and below, the manner of heat transmission to the toner during fixing is uniform and the low-temperature fixability and releasability during fixing are excellent. From the standpoint of the charge stability and fixing performance, from 0.5 mass parts to 10.0 mass parts is preferred and from 1.0 mass parts to 6.0 mass parts is more preferred.

The toner particle may be mixed with the inorganic fine particles using a known mixer, e.g., a Henschel mixer, Mechano Hybrid (Nippon Coke & Engineering Co., Ltd.), Supermixer, or Nobilta (Hosokawa Micron Corporation), but there is no particular limitation on the mixer.

The strontium titanate particles that are an example of the inorganic fine particles can be obtained by a normal-pressure thermal reaction method. In this case, preferably the mineral acid-peptized product from the hydrolyzate of a titanium compound is used as the titanium oxide source and a water-soluble acidic strontium compound is used as the strontium oxide source. Production can be carried out by a method in which their liquid mixture is reacted at 60° C. or above while adding an aqueous alkali solution, followed by an acid treatment.

Normal-Pressure Thermal Reaction Method

The product of the mineral acid peptization of a hydrolyzate of a titanium compound can be used as the titanium oxide source. The use is preferred of the product provided by carrying out peptization, by adjusting the pH to 0.8 to 1.5 using hydrochloric acid, on a meta-titanic acid obtained by the sulfuric acid method and having an $SO_3$ content of not more than 1.0 mass % and preferably not more than 0.5 mass %.

The nitric acid salt, hydrochloric acid salt, and so forth of the metal, for example, strontium nitrate or strontium chloride, can be used as the strontium oxide source.

An alkali hydroxide can be used for the aqueous alkali solution, whereamong an aqueous sodium hydroxide solution is preferred.

The following, for example, are factors that influence the particle diameter during the production of the strontium titanate particles: the mixing proportions of the titanium oxide source and the strontium oxide source in the reaction, the concentration of the titanium oxide source at the start of the reaction, and the temperature and rate of addition when the aqueous alkali solution is added. These can be adjusted as appropriate in order to obtain a product having the target particle diameter and particle size distribution. The admixture of carbon dioxide is preferably prevented, for example, by carrying out the reaction under a nitrogen gas atmosphere, in order to prevent carbonate production during the reaction process.

A factor in strontium titanate particle production that exercises an influence on the dielectric constant is the conditions/process for breaking down the particle crystallinity. In particular, the execution, in a state in which a high concentration has been established for the reaction solution, of a process of applying energy that disrupts crystal growth is preferred in order to obtain strontium titanate particles having a low dielectric constant. An example of a specific method is the application of microbubbling with nitrogen in the crystal growth step. In addition, the content of rectangular parallelepiped-shaped particles can also be controlled using the flow range during the nitrogen microbubbling.

The mixing proportion between the titanium oxide source and strontium oxide source in the reaction, expressed as the $SrO/TiO_2$ molar ratio, is preferably 0.9 to 1.4 and more preferably 1.05 to 1.20. The residual presence of unreacted titanium oxide is suppressed when this range is obeyed. The concentration of the titanium oxide source at the start of the reaction, expressed as $TiO_2$, is preferably 0.05 to 1.3 mol/L and is more preferably 0.08 to 1.0 mol/L.

The temperature when the aqueous alkali solution is added is preferably 60° C. to 100° C. With regard to the rate of addition of the aqueous alkali solution, a slower rate of addition provides a strontium titanate particle with a larger particle diameter, while a faster rate of addition provides a strontium titanate particle with a smaller particle diameter. The rate of addition of the aqueous alkali solution, with reference to the starting material charged, is preferably 0.001 to 1.2 eq/h and more preferably 0.002 to 1.1 eq/h and can be adjusted as appropriate in correspondence to the particle diameter to be obtained.

Acid Treatment

The strontium titanate particles yielded by the normal-pressure thermal reaction are preferably also subjected to an acid treatment. When the mixing proportion between the titanium oxide source and strontium oxide source, expressed as the $SrO/TiO_2$ molar ratio, exceeds 1.0 when the strontium titanate particles are synthesized by the normal-pressure thermal reaction, the metal source, other than the unreacted titanium remaining after the completion of the reaction, can react with carbon dioxide in the air to produce impurities such as metal carbonates. When impurities such as metal carbonates remain on the surface, uniform coverage by the organic surface treatment agent may be impaired when an organic surface treatment is performed in order to impart hydrophobicity. Accordingly, after the addition of the aqueous alkali solution, an acid treatment is preferably performed in order to remove unreacted metal source.

The pH in the acid treatment is adjusted preferably to 2.5 to 7.0 and more preferably 4.5 to 6.0 using hydrochloric acid. Besides hydrochloric acid, for example, nitric acid, acetic acid, and so forth can be used as the acid in the acid treatment.

Other Additives

In addition to the inorganic fine particles described in the preceding, other inorganic fine powders may as necessary also be incorporated in the toner in order to adjust the charge quantity and/or flowability. The inorganic fine powder may be internally added or externally added to the toner particle. Inorganic fine powders such as those of silica, titanium oxide, aluminum oxide, magnesium oxide, and calcium oxide are preferred as external additives. The inorganic fine powder is preferably hydrophobed using a hydrophobing agent such as a silane compound, silicone oil, or mixture thereof.

The specific surface area of the external additive is preferably from 10 $m^2/g$ to 50 $m^2/g$ from the standpoint of inhibiting burial of the external additive.

In addition, this external additive is preferably used at from 0.1 mass parts to 5.0 mass parts per 100 mass parts of the toner particle.

A known mixer, such as a Henschel mixer, can be used to mix the toner particle with the external additive; however, the apparatus is not particularly limited as long as mixing can be carried out.

Binder Resin

There are no particular limitations on the binder resin, but the binder resin preferably contains a polyester resin from the standpoint of the releasability during fixing and control of the charging performance. The binder resin more preferably contains an amorphous polyester and even more preferably is an amorphous polyester.

Common amorphous polyester resins constituted of an alcohol component and an acid component can be used as the amorphous polyester resin, and examples of these two components are provided in the following.

The alcohol component can be exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, and bisphenol derivatives represented by the following formula (1). Bisphenols, e.g., hydrogenated bisphenol A and bisphenol derivatives represented by the following formula (1), are preferred.

(1)

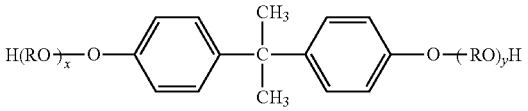

[In the formula, R is an ethylene group or propylene group, x and y are each integers equal to or greater than 0, and the average value of x+y is 1 to 10.]

The alcohol component is also exemplified by polyhydric alcohols such as glycerol, pentaerythritol, sorbitol, sorbitan, and the oxyalkylene ethers of novolac-type phenolic resins.

The dibasic carboxylic acid constituting the amorphous polyester resin, on the other hand, can be exemplified by benzenedicarboxylic acids and their anhydrides, e.g., phthalic acid, terephthalic acid, isophthalic acid, and phthalic anhydride, and by alkyldicarboxylic acids such as succinic acid, adipic acid, sebacic acid, and azelaic acid and their anhydrides. Additional examples are succinic acid substituted by an alkyl group or alkenyl group having 6 to 18 carbons, and anhydrides thereof, as well as unsaturated dicarboxylic acids, such as fumaric acid, maleic acid, citraconic acid, and itaconic acid and their anhydrides. Other examples are polybasic carboxylic acids, e.g., trimellitic acid, pyromellitic acid, 1,2,3,4-butanetetracarboxylic acid, and benzophenonetetracarboxylic acid and their anhydrides.

The amorphous polyester has an alcohol unit and a carboxylic acid unit (and more preferably has only an alcohol unit and a carboxylic acid unit), and the percentage for alcohol unit derived from a bisphenol A ethylene oxide adduct, with reference to the total of the overall alcohol unit, is at least 30 mass %. At least 40 mass % is more preferred. While the upper limit is not particularly limited, not more than 80 mass % is preferred and not more than 60 mass % is more preferred.

Preferred is an amorphous polyester obtained by the polycondensate of the alcohol component with a carboxylic acid component that contains an aliphatic dicarboxylic acid having from 4 to 18 (more preferably from 6 to 12) carbons. The average number of moles of addition of the ethylene oxide adduct with respect to the bisphenol is preferably from 1.6 mol to 3.0 mol and is more preferably from 1.6 mol to 2.6 mol.

When the ratio for the ethylene oxide adduct is in the indicated range, the compatibility of the crystalline polyester with the amorphous polyester is then excellent and the effect of a strong exudation by the crystalline polyester, together with the wax, to the surface on the image is obtained during fixing. This results in an improved releasability during fixing. In addition, when the number of moles of addition of the ethylene oxide adduct is in the indicated range, the dispersibility of the crystalline polyester can be enhanced, which is more preferred from the standpoint of stabilizing the toner charging performance after durability testing with a low print percentage image in a high-temperature, high-humidity environment.

In addition, when a carboxylic acid component containing an aliphatic dicarboxylic acid having from 4 to 18 carbons is used, this fraction exhibits a strong affinity with the crystalline polyester. Due to this, the crystalline polyester can be present in the vicinity of the toner particle surface and the releasability during fixing is enhanced. From 6 mass % to 40 mass % is more preferred for the ratio, with respect to the carboxylic acid component, of the aliphatic dicarboxylic acid having from 4 to 18 carbons.

In addition to the preceding, for example, alkyldicarboxylic acids, e.g., tetradecanedioic acid, octadecanedioic acid, and their anhydrides and lower alkyl esters, are examples of the aliphatic dicarboxylic acid having from 4 to 18 carbons. Additional examples are compounds having a structure in which a part of the main chain of the preceding is branched by an alkyl group, e.g., the methyl group, ethyl group, or octyl group, or an alkylene group. Additional examples are alicyclic dicarboxylic acids, e.g., tetrahydrophthalic acid.

A known catalyst may be used to produce the amorphous polyester resin.

Examples are metals such as tin, titanium, antimony, manganese, nickel, zinc, lead, iron, magnesium, calcium, and germanium, as well as compounds that contain these metals.

The acid value of the amorphous polyester is preferably from 1 mg KOH/g to 10 mg KOH/g from the standpoint of the charge stability.

From the standpoint of having the low-temperature fixability coexist with the releasability, the amorphous polyester preferably contains an amorphous polyester A having a lower softening point and an amorphous polyester B having a higher softening point.

From the standpoint of the low-temperature fixability and releasability, the content ratio (AB) between the amorphous polyester A having a lower softening point and the amorphous polyester B having a higher softening point is preferably 60/40 to 90/10 on a mass basis.

The softening point of the amorphous polyester A having a lower softening point is preferably from 70° C. to 100° C. from the standpoint of the coexistence between the low-temperature fixability and storability of the toner.

The softening point of the amorphous polyester B having a higher softening point is preferably from 110° C. to 180° C. from the standpoint of the hot offset resistance.

The content of the amorphous polyester in the toner particle is preferably from 60 mass % to 90 mass %. The coexistence of an excellent low-temperature fixability with an excellent releasability during fixing is facilitated in this range.

In addition to the amorphous polyester described above, a polymer as described below may also be used as another binder resin with the goal of improving the pigment dispersibility and/or improving the charge stability and blocking resistance of the toner.

When the dispersibility of the release agent and pigment is improved, this is connected to an improved dispersibility by the crystalline polyester microcrystals in the vicinity of the toner particle surface, and as a consequence this other resin is preferably incorporated in the toner as a dispersing agent.

The other resin used in the binder resin can be exemplified by the following resins: homopolymers of styrene and its substituted forms, e.g., polystyrene, poly-p-chlorostyrene, and polyvinyltoluene; styrene copolymers, e.g., styrene-p-chlorostyrene copolymer, styrene-vinyltoluene copolymer, styrene-vinylnaphthalene copolymer, styrene-acrylate ester copolymers, styrene-methacrylate ester copolymers, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, and styrene-acrylonitrile-indene copolymer; as well as polyvinyl chloride, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins.

The toner particle preferably contains amorphous polyester as binder resin.

Crystalline Polyester

The toner particle contains a crystalline polyester. The crystalline polyester preferably is the polycondensate of a monomer composition that contains aliphatic diol and aliphatic dicarboxylic acid as its main components. From the standpoint of achieving coexistence at a higher level between the low-temperature fixability and releasability during fixing, the crystalline polyester preferably is a polycondensate of a diol component that contains as its major component an aliphatic diol having from 6 to 16 (more preferably from 10 to 14) carbons, and a dicarboxylic acid component that contains as its major component an aliphatic dicarboxylic acid having 6 to 16 (more preferably 10 to 14) carbons.

There are no particular limitations on the aliphatic diol, but it is preferably a chain (more preferably a straight chain) aliphatic diol and can be exemplified by ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol.

Preferred examples in particular among the preceding are straight-chain aliphatic α, ω-diols such as ethylene glycol, diethylene glycol, 1,4-butanediol, and 1,6-hexanediol.

Preferably at least 50 mass % and more preferably at least 70 mass % of the diol component is selected from aliphatic diols having from 6 to 16 carbons. More preferably at least 80 mass % of the diol component is selected from aliphatic diols having from 6 to 16 carbons.

A polyhydric alcohol monomer other than the aforementioned aliphatic diol may also be used. Among polyhydric alcohol monomers, the dihydric alcohol monomers can be exemplified by aromatic alcohols such as polyoxyethylated bisphenol A and polyoxypropylated bisphenol A, as well as by 1,4-cyclohexanedimethanol.

Among polyhydric alcohol monomers, the at least trihydric polyhydric alcohol monomers can be exemplified by aromatic alcohols such as 1,3,5-trihydroxymethylbenzene and by aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

On the other hand, there are no particular limitations on the aliphatic dicarboxylic acid, but it is preferably a chain (more preferably a straight chain) aliphatic dicarboxylic acid. Specific examples are oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid, including the hydrolyzates of their anhydrides and lower alkyl esters.

Preferably at least 50 mass % and more preferably at least 70 mass % of the dicarboxylic acid component is selected from aliphatic dicarboxylic acids having from 6 to 16 carbons. More preferably at least 80 mass % of the dicarboxylic acid component is selected from aliphatic dicarboxylic acids having from 6 to 16 carbons.

A polybasic carboxylic acid other than the aforementioned aliphatic dicarboxylic acid may also be used. Among such additional polybasic carboxylic acid monomers, the dibasic carboxylic acids can be exemplified by aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid; also included here are the anhydrides and lower alkyl esters of the preceding.

Among such additional carboxylic acid monomers, the at least tribasic polybasic carboxylic acids can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid, and by aliphatic carboxylic acids such as 1,2,4-butanetricarboxylic acid, 1,2,5-hexanetricarboxylic acid, and 1,3-dicarboxyl-2-methyl-2-methylenecarboxypropane; also included here are the anhydrides and lower alkyl esters of the preceding.

The content of the crystalline polyester resin in the toner particle must be from 0.5 mass parts to 20.0 mass parts per 100 mass parts of the binder resin. It is difficult to produce the effect with respect to the releasability during fixing at less than 0.5 mass %, while the charging performance is reduced at more than 20.0 mass parts. Viewed from the standpoint of the coexistence of the releasability during fixing and the charging performance, this content is preferably from 1.0 mass parts to 6.0 mass parts and more preferably from 2.0 mass parts to 4.0 mass parts.

Crystalline resin is a resin for which an endothermic peak is observed in measurement by differential scanning calorimetry (DSC).

It is essential, in a cross section of each of the toner particles observed by a transmission electron microscope (TEM), the following items (i) to (iii) are satisfied.

(i) The crystalline polyester is observed as domains. That is, domains of the crystalline polyester are present dispersed in the toner cross section, (ii) when, in a cross section of each of the toner particles, a sum of areas of all the domains is defined as DA, and a sum of areas of the domains present in a region surrounded by a contour of each of the toner particles and a line apart from the contour by 0.50 μm towards inside of each of the toner particles, is defined as DB, a percentage ratio of DB to DA (DB/DA×100) is 10% or more.

That is, the sum of the area occupied by the crystalline polyester domains in the toner cross section in a region to a depth of 0.50 μm from the contour of the toner particle is at least 10% with reference to the sum of the area occupied by the crystalline polyester domains in the whole area of the toner cross section, and (iii) with respect to the crystalline polyester domains present in the region, (iii-a) the number-average value of the length of the major axis of the domains is from 120 nm to 1000 nm, and (iii-b) the number-average value of the aspect ratio of the domains is not more than 4.

It is essential that (i) the crystalline polyester is observed as domains. By having these domains be dispersed, the plasticizing effect for the binder resin is increased and the generation of the effect on the low-temperature fixability is facilitated and in combination with this the releasability during fixing becomes excellent.

It is essential that (ii) when, in a cross section of each of the toner particles, a sum of areas of all the domains is defined as DA, and a sum of areas of the domains present in a region surrounded by a contour of each of the toner particles and a line apart from the contour by 0.50 μm towards inside of each of the toner particles, is defined as DB, a percentage ratio of DB to DA (DB/DA×100(%)) is 10% or more. When this range is obeyed, the generation of the effect on the releasability during fixing is facilitated, and in addition the occurrence of interaction with the inorganic fine particles is facilitated and as a consequence the appearance of the effect with regard to the charge stability is facilitated.

The percentage for the aforementioned occupied area (DB/DA×100(%)) is preferably at least 20% and more preferably at least 40%. The upper limit is not particularly limited, but is preferably not more than 70% and more preferably not more than 60%. This occupied area percentage can be controlled by changing the amount of addition of the crystalline polyester and by changing the percentage in the amorphous polyester resin for the alcohol unit derived from a bisphenol A ethylene oxide adduct. In addition, this can be controlled through the temperature during melt-kneading and through the temperature of the hot air current during heat treatment.

It is essential that (iii) with respect to the crystalline polyester domains observed to a depth of 0.50 μm (in the vicinity of the toner particle surface) from the toner particle surface (the contour of the toner particle in the cross section image), the number-average value of the length of the major axis is from 120 nm to 1,000 nm and the number-average value of the aspect ratio is controlled to not more than 4. The releasability during fixing can be substantially enhanced when these ranges are obeyed. In addition, by controlling into the indicated ranges, charge leakage from the toner surface can be inhibited, and in combination with this, the stable movement of negative charge to the inorganic fine particles occurs efficiently even in a state in which stress has been applied to the toner by low print percentage output.

When the number-average value of the length of the major axis of the crystalline polyester domains is less than 120 nm, the releasability during fixing is reduced and the expression of the charge accumulation effect is impaired. When, on the other hand, this number-average value exceeds 1000 nm, exposure of the crystalline polyester at the toner particle surface is facilitated, negative charge leakage from the toner particle surface is larger than negative charge movement to the inorganic fine particles, and the movement of negative charge to the inorganic fine particles cannot proceed smoothly.

From the standpoint of the releasability during fixing and the charge stability, the number-average value of the length of the major axis is preferably from 200 nm to 600 nm and is more preferably from 300 nm to 400 nm.

Charge leakage readily occurs at the toner particle when the number-average value of the aspect ratio exceeds 4. The lower limit on the aspect ratio is not particularly limited, but is preferably at least 1 and more preferably at least 2.

Controlling the amount of addition of the crystalline polyester is one method for controlling the aspect ratio and the number-average value of the length of the major axis. Other methods are as follows.

By changing the monomer, i.e., the acid and/or alcohol, used for the synthesis of the amorphous polyester and/or crystalline polyester, the length of the major axis can be changed due to changes in the dispersibility and compatibility of the crystalline polyester with respect to the amorphous polyester.

When toner production is carried out by a pulverization method, the length of the major axis can be changed by changing how shear is applied during melt-kneading, by changing the kneading temperature, and by changing the ejection temperature and cooling rate after melt-kneading. When the toner is produced in the liquid phase, e.g., by an emulsion aggregation method or a dissolution suspension method, the length of the major axis of the crystalline polyester domains can be changed by changing the temperature during toner granulation.

The length of the major axis of the crystalline polyester domains present to a depth of 0.50 μm from the toner particle surface can also be changed by heat treatment of the obtained toner particle.

In addition, when toner production is carried out by a pulverization method, the number-average value of the length of the major axis of the crystalline polyester domains can be controlled by changing the cooling rate after melt-kneading. When toner production is carried out in the liquid phase, e.g., by an emulsion aggregation method or a dissolution suspension method, control can be achieved by changing the toner granulation time. When the resulting toner particle is subjected to a heat treatment, the number-average value of the length of the major axis of the crystalline polyester domains can also be controlled by changing the treatment temperature and treatment time therein.

The coverage ratio of the toner particle surface by the inorganic fine particles must be from 5% to 60%. At and above the indicated lower limit, the occurrence of interaction with the crystalline polyester resin domains is facilitated and obtaining the effects with regard to charge stability is facilitated. The low temperature fixability and releasability during fixing assume excellent levels at and below the indicated upper limit.

The coverage ratio is preferably from 5% to 20% and is more preferably from 8% to 15%. The coverage ratio can be controlled by adjusting the amount of addition of the inorganic fine particles and by adjusting the time for mixing the toner particle with the inorganic fine particles.

The fixing ratio for the inorganic fine particles on the surface of each of the toner particles is preferably from 20% to 100% and is more preferably from 70% to 100%. When this range is obeyed, detachment of the inorganic fine particles can be inhibited and as a consequence obtaining the effects with regard to charge stability is facilitated, even in a state in which stress is applied to the toner, e.g., a durability test at a low print percentage. This fixing ratio can be controlled through, for example, the amount of addition of the inorganic fine particles, the mixing time with the toner particle, and the temperature during treatment with a hot air current.

Colorant

The colorant can be exemplified by the following.

The black colorant can be exemplified by carbon black and by colorants provided by color mixing using a yellow colorant, magenta colorant, and cyan colorant to give a black color. A pigment may be used by itself for the colorant; however, the use of a dye/pigment combination brings about an improved sharpness and is thus more preferred from the standpoint of the quality of the full-color image.

Magenta-colored pigments can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; and C. I. Vat Red 1, 2, 10, 13, 15, 23, 29, and 35.

Magenta-colored dyes can be exemplified by the following: oil-soluble dyes such as C. I. Solvent Red 1, 3, 8, 23, 24, 25, 27, 30, 49, 81, 82, 83, 84, 100, 109, and 121; C. I. Disperse Red 9; C. I. Solvent Violet 8, 13, 14, 21, and 27; and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28.

Cyan-colored pigments can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which 1 to 5 phthalimidomethyl groups are substituted on the phthalocyanine skeleton.

Cyan-colored dyes can be exemplified by C. I. Solvent Blue 70.

Yellow-colored pigments can be exemplified by the following: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Yellow-colored pigments can be exemplified by C. I. Solvent Yellow 162.

The amount of use of the colorant is preferably from 0.1 mass parts to 30 mass parts per 100 mass parts of the binder resin.

Wax

The toner preferably contains a wax. The wax can be exemplified by the following:

hydrocarbon waxes such as low molecular weight polyethylene, low molecular weight polypropylene, alkylene copolymers, microcrystalline wax, paraffin wax, and Fischer-Tropsch waxes; oxides of hydrocarbon waxes, such as oxidized polyethylene wax, and their block copolymers; waxes in which the major component is fatty acid ester, such as carnauba wax; and waxes provided by the partial or complete deacidification of fatty acid esters, such as deacidified carnauba wax.

Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between a fatty acid such as palmitic acid, stearic acid, behenic acid, or montanic acid and an alcohol such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinyl monomer such as styrene or acrylic acid; partial esters between a fatty acid and a polyhydric alcohol, such as behenyl monoglyceride; and hydroxyl group-containing methyl ester compounds obtained by the hydrogenation of plant oils.

Hydrocarbon waxes, e.g., paraffin waxes and Fischer-Tropsch waxes, and fatty acid ester waxes, e.g., carnauba wax, are preferred among these waxes from the standpoint of improving the low-temperature fixability and hot offset resistance.

The content of the wax is preferably from 1.0 mass parts to 15.0 mass parts per 100 mass parts of the binder resin. The efficient expression of the hot offset resistance at high temperatures is facilitated when the wax content is in the indicated range.

Viewed from the standpoint of the coexistence of the storability and high-temperature offset of the toner, the peak temperature of the maximum endothermic peak for the wax present in the temperature range from 30° C. to 200° C. in the endothermic curve during ramp up as measured with a differential scanning calorimeter (DSC) is preferably from 50° C. to 110° C.

Wax Dispersing Agent

A resin having both a segment with a polarity close to that of the wax component and a segment close to the polarity of the resin may be added as a wax dispersing agent in order to improve the dispersibility of the wax in the binder resin. A styrene-acrylic resin that has been graft modified with a hydrocarbon compound is specifically preferred. More preferred is a resin composition provided by the reaction (grafting) of a styrene-acrylic resin to a polyolefin, e.g., polyethylene. The content of such a wax dispersing agent (resin composition) is preferably from 1.0 mass parts to 15.0 mass parts per 100 mass parts of the binder resin.

The charge retention behavior of the toner is enhanced when a cyclic hydrocarbon group or an aromatic ring is introduced into the resin segment of the wax dispersing agent. This facilitates an increase in the charging characteristics of the inorganic fine particles by the toner particle.

Charge Control Agent

A charge control agent may also be incorporated in the toner on an optional basis. A known charge control agent can be used for the charge control agent, but metal compounds of aromatic carboxylic acids that are colorless, provide a high toner charging speed, and can maintain a stable and constant amount of charge are particularly preferred.

Negative-charging charge control agents can be exemplified by the following: metal salicylate compounds, metal naphthoate compounds, metal dicarboxylate compounds, polymer compounds having sulfonic acid or carboxylic acid in side chain position, polymer compounds having a sulfonate salt or sulfonate ester in side chain position, polymer compounds having a carboxylate salt or carboxylate ester in side chain position, boron compounds, urea compounds, silicon compounds, and calixarene.

Positive-charging charge control agents can be exemplified by quaternary ammonium salts, polymer compounds having a quaternary ammonium salt in side chain position, guanidine compounds, and imidazole compounds. The charge control agent may be internally added or externally added to the toner particle.

The amount of charge control agent addition is preferably from 0.2 mass parts to 10 mass parts per 100 mass parts of the binder resin.

Developer

The toner can be used as a single-component developer, but use mixed with a magnetic carrier as a two-component developer is preferred in order to bring about a more enhanced dot reproducibility. This is also preferred from the standpoint of obtaining an image that is stable on the long term.

A known magnetic carrier such as the following can be used for the magnetic carrier here: magnetic bodies, e.g., surface-oxidized iron powder; nonoxidized iron powder; metal particles such as those of iron, lithium, calcium, magnesium, nickel, copper, zinc, cobalt, manganese, chromium, and rare earths, as well as their alloy particles, oxide particles, and ferrites, and also magnetic body-dispersed resin carriers (referred to as resin carriers) containing a magnetic body and a binder resin that holds this magnetic body in a dispersed state.

When the toner is mixed with a magnetic carrier and used as a two-component developer, excellent results are generally obtained when the carrier mixing ratio in this case, expressed as the toner concentration in the two-component developer, is preferably from 2 mass % to 15 mass % and is more preferably from 4 mass % to 13 mass %.

Production Method

A known production method, e.g., emulsion aggregation methods, melt-kneading methods, dissolution suspension methods, and so forth, may be used without particular limitation as the toner production method, but a melt-kneading method is preferred from the standpoint of increasing the dispersity of the starting materials. Melt-kneading methods are characterized by melt-kneading a toner composition comprising the starting materials for the toner particle, and pulverizing the resulting kneaded product. The production method is described using an example.

In a starting material mixing step, the materials constituting the toner particle, i.e., the binder resin and crystalline polyester and optionally other components such as a colorant, wax, charge control agent, and so forth, are metered out in prescribed quantities and are blended and mixed.

The mixing apparatus can be exemplified by a double cone mixer, V-mixer, drum mixer, Supermixer, Henschel mixer, Nauta mixer, Mechano Hybrid (Nippon Coke & Engineering Co., Ltd.), and so forth.

The mixed materials are then melt-kneaded to disperse the other starting materials in the binder resin. A batch kneader, e.g., a pressure kneader, Banbury mixer, and so forth, or a continuous kneader can be used in the melt-kneading step, while single-screw extruders and twin-screw extruders represent the mainstream here because they offer the advantage of enabling continuous production.

Examples here are the model KTK twin-screw extruder (Kobe Steel, Ltd.), model TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.), and so forth. In addition, the resin composition yielded by melt-kneading may be rolled using, for example, a two-roll mill, and may be cooled in a cooling step with, for example, water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using a fine pulverizer. The fine pulverizer can be exemplified by a Kryptron System (Kawasaki Heavy Industries, Ltd.), Super Rotor (Nisshin Engineering Inc.), and Turbo Mill (Freund-Turbo Corporation) and by fine pulverizers based on an air jet system.

The toner particle is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The inorganic fine particles are added as described above to the resulting toner particle.

The effects due to the inorganic particles can be satisfactorily obtained when the weight-average particle diameter of the toner particle is from 4.0 μm to 8.0 μm, which is thus preferred. In addition, the toner particle circularity may be increased by the application of a mechanical impact force to the particle or by the execution of a heat treatment on the particle using, for example, a hot air current. Preferably a heat treatment, e.g., with a hot air current, is performed after the addition of the inorganic fine particles to the toner particle. That is, preferably the toner is a heat-treated toner.

The average circularity is preferably from 0.950 to 0.990 in order to provide many charge transfer opportunities and a large friction rubbing force between and among toner particles and increase the charge rise rate.

After the heat treatment, an external additive other than the inorganic fine particles may optionally be added to and mixed with the toner particle (external addition). The mixing apparatus can be exemplified by a double cone mixer, V-mixer, drum mixer, Supermixer, Henschel mixer, Nauta mixer, Mechano Hybrid (Nippon Coke & Engineering Co., Ltd.), and so forth.

The methods used to measure the various properties of the starting materials and toner are described in the following.

Method for Measuring Coverage Ratio of Toner Surface by Inorganic Fine Particles The coverage ratio of the toner surface by the inorganic fine particles is determined as follows.

Elemental analysis of the toner surface is carried out using the following instrument and the following conditions.

Measurement instrument: Quantum 2000 (product name, ULVAC-PHI, Incorporated)
X-ray source: monochrome Al Kα
X-ray setting: 100 μmϕ (25 W (15 kV))
Photoelectron take-off angle: 45°
Neutralizing conditions: use of both neutralizing gun and ion gun
Region analyzed: 300×200 μm
Pass energy: 58.70 eV
Step size: 1.25 eV
Analysis software: MultiPack (PHI)

Here, when the prescribed inorganic fine particles are silica fine particles, the peaks for C is (B. E. 280 to 295 eV), 0 is (B. E. 525 to 540 eV), and Si 2p (B. E. 95 to 113 eV) are used to determine the quantitative value for the Si atom. The thereby obtained quantitative value for the element Si is designated Y1.

Measurement of the silica fine particles per se is then carried out. The procedure described below in "Separation of the Inorganic Fine Particles from the Toner" is used as the method for obtaining the silica fine particles as such from the toner. Using the thereby obtained silica fine particles, elemental analysis of the silica fine particles as such is carried out proceeding as in the elemental analysis of the toner surface as described above, and the thereby obtained quantitative value for the element Si is designated Y2.

The coverage ratio X1 of the toner surface by the silica fine particles is defined in the present invention as follows.

$$\text{Coverage ratio } X1(\text{area } \%)=Y1/Y2\times 100$$

Y1 and Y2 are preferably measured at least twice in order to increase the accuracy of this measurement.

In addition, when the prescribed inorganic fine particles are strontium titanate fine particles, the peaks for C is (B. E. 280 to 295 eV), 0 is (B. E. 525 to 540 eV), and Ti 2p (B. E. 452 to 468 eV) are used to determine the quantitative value for the Ti atom. The thereby obtained quantitative value for the element Ti is designated Y1.

Measurement of the strontium titanate fine particles per se is then carried out. The procedure described below in "Separation of the Inorganic Fine Particles from the Toner" is used as the method for obtaining the strontium titanate fine particles as such from the toner. Using the thereby obtained strontium titanate fine particles, elemental analysis of the strontium titanate fine particles as such is carried out proceeding as in the elemental analysis of the toner surface as described above, and the thereby obtained quantitative value for the element Ti is designated Y2.

The coverage ratio X1 of the toner surface by the strontium titanate fine particles is defined in the present invention as follows.

$$\text{Coverage ratio } X1(\text{area } \%)=Y1/Y2\times 100$$

Y1 and Y2 are preferably measured at least twice in order to increase the accuracy of this measurement.

The coverage ratio by unknown inorganic fine particles having a particular dielectric constant may be determined using the toner as follows.

(1) The shape and particle diameter of the inorganic fine particles present on the toner surface are identified by SEM.

(2) All of the inorganic fine particles are separated from the toner.

(3) The particular inorganic fine particles are distinguished by the results from (1) and dielectric constant measurements and elemental analysis measurements.

(4) The coverage ratio by the particular inorganic fine particles is determined using the method described above.

Method for Measuring Number-Average Particle Diameter of Inorganic Fine Particles The number-average particle diameter of the inorganic fine particles is determined from the image of the toner surface acquired using a Hitachi S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting the Conditions for Observation with the S-4800

The number-average particle diameter is determined using the image obtained by observation with the S-4800 of the backscattered electron image. Liquid nitrogen is introduced to the brim of the anti-contamination trap attached to the S-4800 housing and standing for 30 minutes is carried out. The "PC-SEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [1.1 kV] and the emission current is set to [20 μA]. In the [base] tab of the operation panel, signal selection is set to [SE], [upper (U)] and [+BSE] are selected for the SE detector, and the instrument is placed in backscattered electron image observation mode by selecting [L. A. 100] in the selection box to the right of [+BSE]. Similarly, in the [base] tab of the operation panel, the probe current of the electron optical system condition block is set to [Normal], the focus mode is set to [UHR], and WD is set to [4.5 mm]. The [ON] button in the acceleration voltage display area of the control panel is pressed to apply the acceleration voltage.

(3) Focus Adjustment

Adjustment of the aperture alignment is carried out once some degree of focus has been obtained by turning the [COARSE] focus knob on the operation panel. [Align] in the control panel is clicked and the alignment dialog is displayed and [beam] is selected. The displayed beam is migrated to the center of the concentric circles by turning the STIGMA/ALIGNMENT knobs (X, Y) on the operation panel. [aperture] is then selected and the STIGMA/ALIGNMENT knobs (X, Y) are turned one at a time and adjustment is performed so as to stop the motion of the image or minimize the motion. The aperture dialog is closed and focusing is carried out with autofocus. The magnification is then set to 80,000× (80 k); focus adjustment is performed as above using the focus knob and the STIGMA/ALIGNMENT knobs; and re-focusing is performed using autofocus. This operation is repeated to achieve focus. The accuracy of measurement of the number-average particle diameter readily declines when the plane of observation has a large angle of inclination, and for this reason simultaneous focus of the plane of observation as a whole is selected during focus adjustment and the analysis is carried out with selection of the smallest possible surface inclination.

(4) Image Storage

Brightness adjustment is performed using the ABC mode, and a photograph with a size of 640×480 pixels is taken and saved. Analysis is carried out as follows using this image file. One photograph is taken per one toner, and images are obtained for at least 25 or more toner particles.

(5) Image Analysis

The number-average particle diameter is determined by measuring the particle diameter on at least 500 inorganic fine particles on the toner surface. The number-average particle diameter is calculated in the present invention by performing binarization processing, using Image-Pro Plus ver. 5.0 image analysis software, of the images yielded by the procedure described above. When the inorganic fine particles can be acquired as such, the measurement may also be carried out based on the above-described procedure using the inorganic fine particles.

Method for Measuring Rectangular Parallelepiped Content in Strontium Titanate Fine Particles The number of rectangular parallelepiped (including cubic) particles in the inorganic fine particles is counted using the aforementioned electron microscope images and the rectangular parallelepiped content (number %) is calculated.

Measurement of Dielectric Constant

The complex dielectric constant at a frequency of 1 MHz is measured using a 284A Precision LCR Meter (Hewlett-Packard) after calibration at frequencies of 1 kHz and 1 MHz. A disk-shaped measurement sample with a diameter of 25 mm and a thickness of 0.8 mm is molded by applying a load of 39,200 kPa (400 kg/cm$^2$) for 5 minutes to the inorganic fine particles to be measured. This measurement sample is placed in an ARES (Rheometric Scientific F.E. Ltd.) equipped with a 25 mm-diameter dielectric constant measurement tool (electrodes), and the measurement is performed at a frequency of 1 MHz in an atmosphere with a temperature of 25° C. while applying a load of 0.49 N (50 g).

Separation of Inorganic Fine Particles from Toner

The measurement can also be carried out using the inorganic fine particles separated from the toner using the following method.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube to prepare a dispersion. 1 g of the toner is added to this dispersion, and clumps of the toner are broken up using, for example, a spatula.

The centrifugal separation tube is set into a "KM Shaker" (model: V. SX) from Iwaki Sangyo Co., Ltd., and shaking is carried out for 20 minutes using the condition of 350 roundtrips per 1 minute. After the shaking, the solution is transferred over to a glass tube (50 mL) for swing rotor service and centrifugal separation is carried using a centrifugal separator and conditions of 30 minutes and 3500 rpm.

After the centrifugal separation, the toner is present in the uppermost layer in the glass tube and the inorganic fine particles are present in the aqueous solution side of the lower layer. The aqueous solution of the lower layer is recovered, centrifugal separation is run to effect separation into sucrose and inorganic fine particles, and collection is performed.

Centrifugal separation is repeated as necessary to achieve a satisfactory separation, followed by drying the dispersion and collecting the inorganic fine particles.

Using centrifugal separation, the desired inorganic fine particles are sorted from the collected inorganic fine particles.

Measurement of Volume Resistivity

The volume resistivity of the inorganic fine particles is measured proceeding as follows. A Model 6517 Electrometer (Keithley Instruments, Inc.)/high-resistance system is used for the instrumentation. 25 mm-diameter electrodes are connected, the inorganic fine particles are placed between the electrodes to provide a thickness of approximately 0.5 mm, and the gap between the electrodes is measured while applying a load of approximately 2.0 N.

The resistance is measured after the application of a voltage of 1,000 V for 1 minute to the inorganic fine particles, and the volume resistivity is calculated using the following formula.

$$\text{Volume resistivity}(\Omega\cdot\text{cm})=R\times L$$

R: Resistance value (Ω)

L: Distance between electrodes (cm)

Method for Measuring Weight-Average Particle Diameter (D4) of Toner Particle

The number-average particle diameter (D4) of the toner particle is determined by carrying out the measurements in 25,000 channels for the number of effective measurement channels and performing analysis of the measurement data, using a "Coulter Counter Multisizer 3" (registered trademark, Beckman Coulter, Inc.), a precision particle size distribution measurement instrument operating on the pore electrical resistance method and equipped with a 100-μm aperture tube, and using the accompanying dedicated software, i.e., "Beckman Coulter Multisizer 3 Version 3.51" (Beckman Coulter, Inc.), to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1,600 μA; the gain is set to 2; the electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the aqueous electrolyte solution is introduced into a 100-mL flatbottom glass beaker. To this is added approximately 0.3 mL of the following dilution as a dispersing agent.

Dilution: dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.)

(3) A prescribed amount of deionized water is introduced into the water tank of the ultrasound disperser indicated below, which has an electrical output of 120 W and is equipped with two oscillators (oscillation frequency=50 kHz) disposed such that the phases are displaced by 180°, and approximately 2 mL of Contaminon N is added to this water tank.

Ultrasound disperser: "Ultrasonic Dispersion System Tetora 150" (Nikkaki Bios Co., Ltd.)

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 15° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for Measuring Average Circularity

The average circularity of the toner particle is measured using an "FPIA-3000" (Sysmex Corporation), a flow particle image analyzer, and using the measurement and analysis conditions from the calibration process.

The specific measurement method is as follows. First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.). Approximately 0.02 g of the measurement sample is added, and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. A benchtop ultrasound cleaner/disperser that has an oscillation frequency of 50 kHz and an electrical output of 150 W ("VS-150" (Velvo-Clear Co., Ltd.)) is used as the ultrasound disperser, and a prescribed amount of deionized water is introduced into its water tank and approximately 2 mL of Contaminon N is added to the water tank.

The previously cited flow particle image analyzer fitted with an objective lens (10×) is used for the measurement, and "PSE-900A" (Sysmex Corporation) particle sheath is used for the sheath solution. The dispersion prepared according to the procedure described above is introduced into the flow particle image analyzer and 3,000 toner particles are measured according to total count mode in HPF measurement mode. The average circularity of the toner particle is determined with the binarization threshold value during particle analysis set at 85% and the analyzed particle diameter limited to a circle-equivalent diameter of from 1.985 μm to 39.69 μm.

For this measurement, automatic focal point adjustment is performed prior to the start of the measurement using reference latex particles (a dilution with deionized water of "RESEARCH AND TEST PARTICLES Latex Microsphere Suspensions 5200A", Duke Scientific Corporation). After this, focal point adjustment is preferably performed every two hours after the start of measurement.

In the examples in the present application, the flow particle image analyzer used had been calibrated by the Sysmex Corporation and had been issued a calibration certificate by the Sysmex Corporation. The measurements were carried out under the same measurement and analysis conditions as when the calibration certification was received, with the exception that the analyzed particle diameter was limited to a circle-equivalent diameter of from 1.985 μm to 39.69 μm.

Method for Measuring Peak Molecular Weight (Mp), Number-Average Molecular Weight (Mn), and Weight-Average Molecular Weight (Mw) of Resins The peak molecular weight (Mp), number-average molecular weight (Mn), and weight-average molecular weight (Mw) are measured as follows using gel permeation chromatography (GPC).

First, the sample (resin) is dissolved in tetrahydrofuran (THF) for 24 hours at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

Instrument: HLC8120 GPC (detector: RI) (Tosoh Corporation)

Column: 7-column train of Shodex KF-801, 802, 803, 804, 805, 806, and 807 (Showa Denko Kabushiki Kaisha)

Eluent: tetrahydrofuran (THF)

Flow rate: 1.0 mL/min

Oven temperature: 40.0° C.

Amount of sample injection: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring Softening Point of Resins

The softening point of the resins is measured using a "Flowtester CFT-500D Flow Property Evaluation Instrument" (Shimadzu Corporation), a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

Test mode: ramp-up method
Start temperature: 40° C.
Saturated temperature: 200° C.
Measurement interval: 1.0° C.
Ramp rate: 4.0° C./min
Piston cross section area: 1.000 $cm^2$
Test load (piston load): 10.0 kgf (0.9807 MPa)
Preheating time: 300 seconds
Diameter of die orifice: 1.0 mm
Die length: 1.0 mm Method for Measuring Acid Value of Resins The acid value is the number of milligrams of potassium hydroxide required to neutralize the acid present in 1 g of a sample. The acid value of the binder resin is measured in accordance with JIS K 0070-1992 and is specifically measured using the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the sample is exactly weighed into a 200-mL Erlenmeyer flask and 100 mL of a toluene/ethanol (2:1) mixed solution is added and dissolution is carried out over 5 hours. Several drops of the phenolphthalein solution are added as indicator and titration is performed using the potassium hydroxide solution. The titration endpoint is taken to be the persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

Method for Measuring Hydroxyl Value of Resins

The hydroxyl value is the number of milligrams of potassium hydroxide required to neutralize the acetic acid bonded to the hydroxyl group when 1 g of the sample is acetylated. The hydroxyl value of the resins is measured in accordance with JIS K 0070-1992 and is specifically measured using the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 volume %) and bringing to 100 mL by adding deionized water.

35 g of special-grade potassium hydroxide is dissolved in 20 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.5 mol/L hydrochloric acid is introduced into an Erlenmeyer flask, several drops of the phenolphthalein solution are added, and titration is performed using the potassium hydroxide solution. The 0.5 mol/L hydrochloric acid used is prepared in accordance with JIS K 8001-1998.

(2) Procedure (A) Main Test

A 1.0 g sample of the pulverized resin is exactly weighed into a 200-mL roundbottom flask and exactly 5.0 mL of the above-described acetylation reagent is added using a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution.

The endpoint for the titration is taken to be the point at which the pale pink color of the indicator persists for approximately 30 seconds.

(B) Blank Test

Titration is performed using the same procedure as described above, but without using the resin sample.

(3) The hydroxyl value is calculated by substituting the obtained results into the following formula.

$$A=[\{(B-C)\times 28.05\times f\}/S]+D$$

Here, A: hydroxyl value (mg KOH/g); B: amount (mL) of addition of the potassium hydroxide solution in the blank test; C: amount (mL) of addition of the potassium hydroxide solution in the main test; f: factor for the potassium hydroxide solution; S: mass of sample (g); and D: acid value (mg KOH/g) of the resin.

Measurement of Peak Temperature and Exothermic Quantity for Wax and Crystalline Polyester The peak temperature and exothermic quantity are measured for the wax and crystalline polyester based on ASTM D3418-82 using a "Q1000" differential scanning calorimeter (TA Instruments). Temperature correction in the instrument detection section is performed using the melting points of indium and zinc, and the amount of heat is corrected using the heat of fusion of indium.

Specifically, an approximately 5 mg sample (toner) is exactly weighed out and this is introduced into an aluminum pan, and the measurement is carried out according to the following procedure using an empty aluminum pan for reference.

A step (step I) of heating from 20° C. to 180° C. at a ramp rate of 10° C./min;

a step (step II) of then cooling to 20° C. at a cooling rate of 10° C./min; and a step (step III) of then reheating from 20° C. to 180° C. at a ramp rate of 10° C./min.

With reference to the measurement in step II, T2w is designated the peak temperature (° C.) and H2w is designated the exothermic quantity (J/g) of the peak originating with the wax, and T2c is designated the peak temperature (° C.) and H2c is designated the exothermic quantity (J/g) originating with the crystalline polyester. In addition, the temperature corresponding to the maximum endothermic peak in the DSC curve measured in step III is designated the peak temperature of the maximum endothermic peak for the wax.

In the present invention, the relationship between T2w, i.e., the peak temperature (° C.) of the peak originating with the wax, and T2c, i.e., the peak temperature (° C.) originating with the crystalline polyester, is preferably $8.0 \leq T2w-T2c$, more preferably $9.0 \leq T2w-T2c \leq 20.0$, and still more preferably $9.0 \leq T2w-T2c \leq 15.0$.

The solidification temperatures of the wax and crystalline polyester are not too close to one another when the indicated range is satisfied. Due to this, the gaps produced when the wax solidifies can be satisfactorily filled by the crystalline polyester and the image smoothness is increased and the releasability during fixing becomes excellent.

In the present invention, the relationship between H2w, i.e., the exothermic quantity (J/g) of the peak originating with the wax, and H2c, i.e., the exothermic quantity (J/g) of the peak originating with the crystalline polyester, is preferably $0.8 \leq H2w/H2c \leq 8.0$, more preferably $1.0 \leq H2w/H2c \leq 6.0$, and still more preferably $1.5 \leq H2w/H2c \leq 4.0$.

When $0.8 \leq H2w/H2c$, the abundance ratio for the wax, for which the viscosity in the melt state is lower, is relatively large and an excellent releasability is then provided.

The wax has a suitable abundance ratio when $H2w/H2c \leq 8.0$, and even when the release agent component forms a layer upon melting, the upper layer (outermost surface of the image) is not too thick and the low-temperature fixability is excellent as a consequence. T2w can be controlled through the melting point of the wax that is used. H2w can be controlled by changing the amount of wax addition and by varying the percentage in the amorphous polyester resin of the alcohol unit derived from a bisphenol A ethylene oxide adduct. T2c can be controlled by varying the melting point and ester group concentration for the crystalline polyester that is used. H2c can be controlled by varying the amount of addition of the crystalline polyester and by varying the percentage in the amorphous polyester resin of the alcohol unit derived from a bisphenol A ethylene oxide adduct.

Measurement for Crystalline Polyester Domains of Areas Occupied, Number-Average Value of Length of Major axis, and Number-Average Value of Aspect Ratios (Evaluation of State of Crystalline Polyester Dispersion in Toner Cross section by TEM)

Observation of the cross section and evaluation of the crystalline polyester domains can be carried out on the toner using a transmission electron microscope (TEM) and proceeding as follows.

The crystalline polyester resin is obtained in the form of a bright contrast by staining the toner cross section with ruthenium. The crystalline polyester resin stains more weakly than the organic components that constitute the interior of the toner. While the stain material does penetrate into the crystalline polyester resin, it is thought that due to, e.g., density differences and so forth, this occurs more weakly than for the organic components in the toner interior.

Due to differences in the amount of ruthenium atom as a function of the strength/weakness of the staining, strongly stained regions contain large amounts of this atom and they appear black on the observed image because the electron beam is then not able to pass through. The electron beam easily passes through the weakly stained regions, which then appear white on the observed image.

Using an osmium plasma coater (OPC80T, Filgen, Inc.), an Os film (5 nm) and a naphthalene film (20 nm) are executed on the toner as protective films. After embedding with D800 photocurable resin (JEOL Ltd.), toner cross sections with a film thickness of 60 nm (or 70 nm) are prepared using an ultrasound ultramicrotome (UC7, Leica) and a slicing rate of 1 mm/s.

The obtained cross sections are stained for 15 minutes in a 500 Pa $RuO_4$ gas atmosphere using a vacuum electronic staining device (VSC4R1H, Filgen, Inc.), and STEM observation is carried out using the STEM mode of a TEM (JEM2800, JEOL Ltd.).

Image acquisition is performed using a STEM probe size of 1 nm and an image size of 1,024×1,024 pixels.

The resulting image is subjected to binarization (threshold=120/255 gradations) using "Image-Pro Plus" (Media Cybernetics, Inc.) image processing software. The crystalline domains can be extracted by binarization, and their size is measured. For the present invention, measurement is performed, on the cross sections observed for 20 randomly selected toner particles, of the lengths of the major axis and short diameter of all the crystalline domains of the crystalline polyester for which the length can be measured.

During this procedure, the number-average value (number-average diameter (Dc)) of the length of the major axis of the crystalline polyester crystals is determined for the region 0.50 μm to the interior from the toner surface (contour of the cross section) (that is, number-average of the length of the major axis of the domains is determined for the region surrounded by the contour of the toner particle and a line apart from the contour by 0.50 μm towards inside of the toner particle). The number-average value of the aspect ratio is also calculated from the lengths obtained for the major axis and short diameter. Measurement was not performed on those crystals that extended over the boundary (were present on the boundary) 0.50 μm from the toner surface.

In addition, a line delineating the region 0.50 μm to the interior from the toner surface (contour of the cross section) is drawn, and the area occupied by the crystalline polyester domains in the region to a depth of 0.50 μm from the toner particle contour (DB) is determined (that is, a sum of areas (DB) of the domains present in a region surrounded by a contour of the toner particle and a line apart from the contour by 0.50 μm towards inside of the toner particle is determined). The area of the domains present in the total area of the toner particle cross section (DA) is determined, and the percentage for the area occupied by the crystalline polyester domains in the region to a depth of 0.50 μm from the toner particle contour (DB/DA×100(%)) is determined. The arithmetic mean for 20 toner particle cross sections is calculated.

Measurement of Fixing Ratio of Inorganic Fine Particles on Surface of Toner Particle The fixed inorganic fine particles are defined as follows in the present invention.

A dispersion is prepared by introducing, in a 30-mL glass vial (for example, VCV-30 from Nichiden-Rika Glass Co., Ltd., outer diameter: 35 mm, height: 70 mm), 6 mL of the surfactant Contaminon N (neutral pH 7 detergent for cleaning precision measurement instrumentation, comprising a nonionic surfactant, anionic surfactant, and organic builder, Wako Pure Chemical Industries, Ltd.) into an aqueous sucrose solution of 20.7 g of sucrose (Kishida Chemical Co., Ltd.) dissolved in 10.3 g of deionized water, and thoroughly mixing. 1.0 g of the toner is added to this vial, and standing at quiescence is carried out until the toner has naturally sedimented, thus yielding the pretreatment dispersion. This dispersion is shaken for 5 minutes at a shaking rate of 200 rpm using a shaker (YS-8D, YAYOI Co., Ltd.). An inorganic fine particle that has not been shed even after this shaking is regarded as fixed. The toner on which inorganic fine particles are still present is separated from the detached inorganic fine particles using centrifugal separation. The centrifugal separation process is carried out for 30 minutes at 3700 rpm. The toner on which inorganic fine particles are still present is recovered by suction filtration and dried to provide a post-separation toner.

The fixing ratio is measured proceeding as follows, for example, in the case of silica fine particles. Quantitation of the silica fine particles contained in the toner prior to the aforementioned separation procedure is carried out first. The Si element intensity: Si—B for the toner is measured using an Axios Advanced wavelength-dispersive x-ray fluorescence analyzer (PANalytical B.V.). The Si element intensity: Si-A for the post-separation toner is then measured in the same manner. The fixing ratio is determined with (Si-A/Si—B)×100(%). With inorganic fine particles having a different composition, the determination can be carried out by performing the same measurement using an element that constitutes the inorganic fine particle.

Measurement of Crystalline Polyester Content in Toner

The crystalline polyester content is determined from the integration values in the spectrum provided by nuclear magnetic resonance spectroscopic analysis ($^1$H-NMR) of the toner, based on the individual spectra provided by nuclear magnetic resonance spectroscopic analysis ($^1$H-NMR) of the binder resin and crystalline polyester.

Measurement instrument: JNM-EX400 FT-NMR instrument (JEOL Ltd.)

Measurement frequency: 400 MHz

Pulse condition: 5.0 μs

Frequency range: 10500 Hz

Number of scans: 64

The ratio, on a mass basis, between the polyester segment and amorphous segment is calculated from the integration values in the resulting spectrum.

EXAMPLES

The present invention is described in the following using production examples and examples. The present invention is not limited to or by these. The number of parts in the following blends indicate mass parts unless specifically indicated otherwise.

Amorphous Polyester A1 Production Example

Polyoxypropylene(2.2)-2,2-bis(4-hydroxyphenyl)propane: 73.3 parts (0.20 mol; 100.0 mol % with reference to the total number of moles of polyhydric alcohol)

Terephthalic acid: 22.4 parts (0.13 mol; 82.0 mol % with reference to the total number of moles of polybasic carboxylic acid)

Adipic acid: 4.3 parts (0.03 mol; 18.0 mol % with reference to the total number of moles of polybasic carboxylic acid)

Titanium tetrabutoxide (esterification catalyst): 0.5 parts

These materials were metered into a reactor equipped with a condenser, stirrer, nitrogen introduction line, and thermocouple. The interior of the flask was then substituted with nitrogen gas, the temperature was subsequently gradually raised while stirring, and, while stirring at a temperature of 200° C., a reaction was run for 4 hours to obtain an amorphous polyester resin A1. The softening point of the obtained amorphous polyester A1 was 90° C.

Amorphous Polyesters A2 to A8 Production Example

Amorphous polyester resins A2 to A8 were obtained by running reactions as in the synthesis example for amorphous polyester A1, but changing the alcohol component used and the carboxylic acid component used and the number of parts as shown in Table 1.

TABLE 1

| Amorphous polyester resin No. | Alcohol BPA-PO (2.2) | Alcohol BPA-EO (2.2) | Acid Terephthalic acid | Acid Adipic acid C6 | Flow softening point Tm (° C.) |
|---|---|---|---|---|---|
| A1 | 73.3 | — | 22.4 | 4.3 | 90 |
| A2 | 66.0 | 7.3 | 22.4 | 4.3 | 88 |
| A3 | 58.6 | 14.7 | 22.4 | 4.3 | 86 |
| A4 | 51.3 | 22.0 | 22.4 | 4.3 | 85 |
| A5 | 36.6 | 36.7 | 22.4 | 4.3 | 85 |
| A6 | 22.0 | 51.3 | 22.4 | 4.3 | 85 |

TABLE 1-continued

| Amorphous polyester resin No. | Alcohol BPA-PO (2.2) | Alcohol BPA-EO (2.2) | Acid Terephthalic acid | Acid Adipic acid C6 | Flow softening point Tm (° C.) |
|---|---|---|---|---|---|
| A7 | 7.3 | 66.0 | 22.4 | 4.3 | 85 |
| A8 | — | 73.3 | 22.4 | 4.3 | 85 |

BPA-EO (2.2): Bisphenol A ethylene oxide adduct (average number of moles of addition: 2.2 mol)
BPA-PO (2.2): Bisphenol A propylene oxide adduct (average number of moles of addition: 2.2 mol)

The numerical values for the alcohol and acid in the table indicate the number of parts.

Amorphous Polyester B Production Example

Polyoxypropylene(2.2)-2,2-bis(4-hydroxyphenyl)propane: 72.4 parts (0.20 mol; 100.0 mol % with reference to the total number of moles of polyhydric alcohol)

Terephthalic acid: 22.4 parts (0.13 mol; 80.0 mol % with reference to the total number of moles of polybasic carboxylic acid)

Adipic acid: 3.4 parts (0.02 mol; 14.0 mol % with reference to the total number of moles of polybasic carboxylic acid)

Titanium tetrabutoxide (esterification catalyst): 0.5 parts

These materials were metered into a reactor equipped with a condenser, stirrer, nitrogen introduction line, and thermocouple. The interior of the flask was then substituted with nitrogen gas, the temperature was subsequently gradually raised while stirring, and a reaction was run for 2 hours while stirring at a temperature of 200° C.

The pressure in the reactor was dropped to 8.3 kPa, and, after holding for 1 hour, cooling to 180° C. was carried out and the system was returned to atmospheric pressure (first reaction step).

Trimellitic anhydride: 2.1 parts (0.01 mol; 6.0 mol % with reference to the total number of moles of polybasic carboxylic acid)

tert-Butylcatechol (polymerization inhibitor): 0.1 parts

These materials were then added, the pressure in the reactor was dropped to 8.3 kPa, a reaction was run for 15 hours while maintaining the system as such at a temperature of 160° C., and, after confirming that the softening point as measured in accordance with ASTM D36-86 had reached a temperature of 140° C., the temperature was reduced and the reaction was stopped (second reaction step) to obtain an amorphous polyester B. The softening point of the obtained amorphous polyester B was 140° C.

Crystalline Polyester Resin 1 Synthesis Example

Dodecanediol: 34.5 parts (0.29 mol; 100.0 mol % with reference to the total number of moles of polyhydric alcohol)

Sebacic acid: 65.5 parts (0.28 mol; 100.0 mol % with reference to the total number of moles of polybasic carboxylic acid)

These materials were metered into a reactor equipped with a condenser, stirrer, nitrogen introduction line, and thermocouple. The interior of the flask was then substituted with nitrogen gas, the temperature was subsequently gradually raised while stirring, and a reaction was run for 3 hours while stirring at a temperature of 140° C.

Tin 2-ethylhexanoate: 0.5 parts

This material was then added, the pressure in the reactor was dropped to 8.3 kPa, a reaction was run for 4 hours while maintaining the system as such at a temperature of 200° C., and the pressure in the reactor was subsequently gradually released to return to normal pressure and obtain crystalline polyester resin 1. The obtained crystalline polyester resin 1 exhibited a melting peak deriving from crystallinity.

Crystalline Polyester Resins 2 to 6 Production Example

Crystalline polyester resins 2 to 6 were obtained proceeding as in the Crystalline Polyester Resin 1 Synthesis Example, but changing the alcohol component and carboxylic acid component as shown in Table 2. The obtained crystalline polyester resins 2 to 6 each exhibited a melting peak deriving from crystallinity.

TABLE 2

| Crystalline polyester resin No. | Acid Succinic acid C4 | Acid Adipic acid C6 | Acid Sebacic acid C10 | Acid Dodecanedioic acid C12 | Acid Hexadecanedioic acid C16 | Alcohol Butanediol C4 | Alcohol Decanediol C10 | Alcohol Dodecanediol C12 | Alcohol Hexadecanediol C16 |
|---|---|---|---|---|---|---|---|---|---|
| 1 | | | 100 mol % | | | | | 100 mol % | |
| 2 | | 100 mol % | | | | | | 100 mol % | |
| 3 | | | | 100 mol % | | | | 100 mol % | |
| 4 | | | | 100 mol % | | | 100 mol % | | |
| 5 | 100 mol % | | | | | | | | 100 mol % |
| 6 | | | | | 100 mol % | 100 mol % | | | |

Resin Composition 1 Production Example

| | |
|---|---|
| Low-density polyethylene (Mw = 1,400, Mn = 850, maximum endothermic peak by DSC = 100° C.) | 18 parts |
| Styrene | 66 parts |
| n-Butyl acrylate | 13.5 parts |
| Acrylonitrile | 2.5 parts |

were introduced into an autoclave, the interior of the system was replaced with $N_2$, and the temperature was then raised and was held at 180° C. while stirring. 50 parts of a xylene solution of 2 mass % t-butyl hydroperoxide was continuously added dropwise into the system over 5 hours. After cooling, the solvent was separated and removed to yield a resin composition 1, which had a vinyl resin component reacted onto the low-density polyethylene. Measurement of the molecular weight of resin composition 1 gave a weight-average molecular weight (Mw) of 7100 and a number-average molecular weight (Mn) of 3000. 69% was obtained for the transmittance at a wavelength of 600 nm as measured at a temperature of 25° C. on a dispersion provided by dispersion in 45 volume % aqueous methanol.

Inorganic Fine Particle 1 Production Example

A meta-titanic acid provided by the sulfuric acid method was subjected to an iron removal and bleaching treatment; this was followed by the addition of an aqueous sodium hydroxide solution to bring the pH to 9.0 and the execution of a desulfurization treatment; and neutralization to pH 5.8 was then carried out with hydrochloric acid and filtration and water washing were performed. Water was added to the washed cake to make a slurry having 1.5 mol/L as $TiO_2$; this was followed by the addition of hydrochloric acid to pH 1.5 and the execution of a peptization treatment.

The desulfurized and peptized meta-titanic acid was recovered as $TiO_2$ and was introduced into a 3-L reactor. An aqueous strontium chloride solution was added to this peptized meta-titanic acid slurry to provide an $SrO/TiO_2$ molar ratio of 1.15, after which the $TiO_2$ concentration was adjusted to 0.8 mol/L. The temperature was then raised to 90° C. while stirring and mixing, and, while carrying out microbubbling with nitrogen gas at 600 mL/min, 444 mL of a 10 mol/L aqueous sodium hydroxide solution was subsequently added over 50 minutes. This was followed by stirring for 1 hour at 95° C. while microbubbling with nitrogen gas at 400 mL/min.

The reaction slurry was then rapidly cooled to 15° C. by stirring while injecting 10° C. cooling water into the jacket on the reactor; hydrochloric acid was added until the pH reached 2.0; and stirring was continued for 1 hour. The resulting precipitate was washed by decantation; 6 mol/L hydrochloric acid was then added to adjust the pH to 2.0; 9.2 parts of n-octylethoxysilane was added per 100 parts of the solid fraction; and stirring was performed for 18 hours. Neutralization was carried out using a 4 mol/L aqueous sodium hydroxide solution; filtration and separation were performed after stirring for 2 hours; and inorganic fine particle 1 was obtained by drying for 8 hours in the atmosphere at 120° C. The properties are shown in Table 3.

Inorganic Fine Particles 2 to 9 Production Example

Inorganic fine particles 2 to 9 were produced using the same method as for inorganic fine particle 1, but changing the duration of NaOH addition, the microbubbling conditions, and the surface treatment as indicated in Table 3.

Inorganic Fine Particle 10 Production Example

Washing with an aqueous alkali solution was carried out on a hydrous titanium oxide slurry obtained by the hydrolysis of an aqueous titanyl sulfate solution. Hydrochloric acid was then added to the hydrous titanium oxide slurry to adjust the pH to 0.65 and obtain a titania sol dispersion. NaOH was added to this titania sol dispersion to adjust the pH of the dispersion to 4.5, and washing was done repeatedly until the conductivity of the supernatant reached 70 μS/cm.

$Sr(OH)_2.8H_2O$ was added in an amount that was 0.97-times the hydrous titanium oxide on a molar basis followed by introduction into an SUS reactor and substitution with nitrogen gas. Distilled water was added to bring to 0.1 to 2.0 mol/liter as $SrTiO_3$.

This slurry, oxygen gas, and propane gas were sprayed into an 80-L combustion reaction chamber from a fine particle spray nozzle and combustion was carried out, followed by passage through a filter and collection to obtain fine particles. Pure water was added to the resulting fine particles to prepare a slurry; 6 mol/L hydrochloric acid was added to adjust the pH to 2.0; 3.6 parts of n-octylethoxysilane was added per 100 parts of the solid fraction; and stirring was carried out for 18 hours. Neutralization was performed using a 4 mol/L aqueous sodium hydroxide solution; filtration and separation were carried out after stirring for 2 hours; and inorganic fine particle 10 was obtained by drying for 8 hours in the atmosphere at 120° C. The properties of inorganic fine particle 10 are shown in Table 3.

Inorganic Fine Particle 11 Production Example

Washing with an aqueous alkali solution was carried out on a hydrous titanium oxide slurry obtained by the hydrolysis of an aqueous titanyl sulfate solution. Hydrochloric acid was then added to the hydrous titanium oxide slurry to adjust the pH to 0.7 and obtain a titania sol dispersion. NaOH was added to this titania sol dispersion to adjust the pH of the dispersion to 5.0, and washing was done repeatedly until the conductivity of the supernatant reached 70 μS/cm.

$Sr(OH)_2.8H_2O$ was added in an amount that was 0.98-times the hydrous titanium oxide on a molar basis followed by introduction into an SUS reactor and substitution with nitrogen gas. Distilled water was added to bring to 0.5 mol/liter as $SrTiO_3$. The slurry was heated in a nitrogen atmosphere at 7° C./hour to 80° C., and a reaction was run for 6 hours after 80° C. had been reached. After the reaction, cooling to room temperature was carried out, the supernatant was removed, and washing with pure water was then performed repeatedly.

Then, while operating under a nitrogen atmosphere, the slurry was introduced into an aqueous solution in which sodium stearate had been dissolved at 3 mass % with reference to the slurry solid fraction, and an aqueous calcium sulfate solution was added dropwise while stirring to precipitate calcium stearate on the perovskite crystal surface. The slurry was then repeatedly washed with pure water followed by filtration on a nutsche filter, and the resulting cake was dried to obtain an inorganic fine particle 11, which had not been subjected to a sintering step and the surface of which had been treated with calcium stearate. The properties of inorganic fine particle 11 are given in Table 3.

Inorganic Fine Particle 12 Production Example 600 parts of strontium carbonate and 350 parts of titanium oxide were wet-mixed for 8 hours using a ball mill. This was followed by filtration and drying, and the resulting mixture was molded at a pressure of 10 kg/cm$^2$ and was sintered for 7 hours at 1200° C. This was then subjected to fine grinding to obtain inorganic fine particle 12. The properties of inorganic fine particle 12 are given in Table 3.

Inorganic Fine Particle 13 Production Example

Coke and a pulverizate of a synthetic rutile as starting material were mixed; this was introduced into a fluid bed chlorination furnace heated to around a temperature of 1000° C., and an exothermic reaction was run with co-fed chlorine gas to obtain a crude titanium tetrachloride. Purification was performed by separating the impurities from the resulting crude titanium tetrachloride to obtain an aqueous titanium tetrachloride solution. While holding this aqueous titanium tetrachloride solution at room temperature, an aqueous sodium hydroxide solution was added to adjust the pH to 7.0 and cause the precipitation of colloidal titanium hydroxide. Ageing was carried out for 4 hours at a temperature of 65° C. to provide a slurry of base particles having a rutile nucleus.

Sulfuric acid was added to the slurry to bring the pH to 3; n-octyltriethoxysilane was added; and the temperature was raised to 60° C. over 1 hour to coat the base particle surface with 3.6 parts of n-octyltriethoxysilane per 100 parts of the base particle. This was followed by filtration and washing; the resulting wet cake was heat treated for 24 hours at a temperature of 120° C.; and pulverization then yielded rutile titanium oxide fine particles. The obtained fine particles were classified using a wind force classifier to give inorganic fine particle 13.

TABLE 3

| Inorganic fine particle No. | Type of inorganic fine particle | Particle shape | NaOH (min) | $N_2$ ml/min | Organic surface treatment: Treatment agent 1 | TA mass % | Treatment agent 2 | TA mass % | Number-average diameter (nm) | Dielectric constant pF/m | Particle resistivity (Ω · cm) | RC (%) |
|---|---|---|---|---|---|---|---|---|---|---|---|---|
| 1 | Strontium titanate 1 | Cubic | 50 | 600 + 400 | n-Octyltriethoxy silane | 9.2 | — | — | 35 | 28 | 2.00E+10 | 45 |
| 2 | Strontium titanate 2 | Cubic | 45 | 300 + 500 | n-Octyltriethoxy silane | 14.0 | — | — | 35 | 32 | 2.00E+13 | 45 |
| 3 | Strontium titanate 3 | Cubic | 55 | 600 + 25 | n-Octyltriethoxy silane | 14.0 | — | — | 35 | 55 | 2.00E+13 | 45 |
| 4 | Strontium titanate 4 | Cubic | — | — | n-Octyltriethoxy silane | 7.0 | — | — | 35 | 120 | 4.00E+13 | 45 |
| 5 | Strontium titanate 5 | Cubic | 50 | 600 + 300 | Isobutyl trimethoxysilane | 4.6 | — | — | 35 | 38 | 2.00E+10 | 45 |
| 6 | Strontium titanate 6 | Cubic | 50 | 600 + 200 | Isobutyl trimethoxysilane | 4.6 | 3,3,3-T | 4.6 | 35 | 40 | 1.80E+10 | 45 |
| 7 | Strontium titanate 7 | Cubic | 50 | 600 + 100 | Isobutyl trimethoxysilane | 4.6 | 3,3,3-T | 3.0 | 35 | 42 | 1.80E+10 | 45 |
| 8 | Strontium titanate 8 | Cubic | 50 | 600 + 100 | Isobutyl trimethoxysilane | 4.6 | 3,3,3-T | 2.0 | 35 | 44 | 1.80E+10 | 45 |
| 9 | Strontium titanate 9 | Cubic | 50 | 600 + 100 | Isobutyl trimethoxysilane | 4.6 | 3,3,3-T | 0.5 | 35 | 45 | 2.00E+10 | 45 |
| 10 | Strontium titanate 10 | Cubic | — | — | n-Octyltriethoxy silane | 3.6 | — | — | 80 | 48 | 1.80E+10 | 60 |
| 11 | Strontium titanate 11 | Cubic | — | — | Calcium stearate | 5.0 | — | — | 80 | 50 | 1.80E+10 | 60 |
| 12 | Strontium titanate 12 | Sintered (Irregular shape) | — | — | — | — | — | — | 400 | 70 | 3.00E+12 | 0 |
| 13 | Titanium oxide | Spherical | — | — | n-Octyltriethoxy silane | 3.6 | — | — | 30 | 22 | 1.00E+11 | 0 |

In the Table, NaOH denotes "Duration of addition of aqueous NaOH solution (min)", $N_2$ denotes "$N_2$ microbubbling flow rate mL/min", TA denotes "treatment amount (mass %)", "3,3,3-T" denotes "3,3,3-Trifluoropropyltrimethoxysilane", and RC denotes "Content of rectangular parallelepiped or cubic (%)".

With reference to the powder resistivity values in Table 3, for example, 2.00E+10 indicates $2.00\times10^{10}$.

Toner 1 Production Example

| | |
|---|---|
| Amorphous polyester resin A5 | 70.0 parts |
| Amorphous polyester resin B | 30.0 parts |
| Crystalline polyester resin 1 | 2.0 parts |
| Fischer-Tropsch wax (Peak temperature of maximum endothermic peak = 78° C.) | 5.0 parts |

-continued

| | |
|---|---|
| Resin composition 1 | 5.0 parts |
| C.I. Pigment Blue 15:3 | 5.0 parts |
| Aluminum 3,5-di-t-butylsalicylate compound | 0.5 parts |

The starting materials listed in the preceding formulation were mixed at a rotation rate of 20 $s^{-1}$ for a rotation time of 5 minutes using a Henschel mixer (Model FM-75, Nippon Coke & Engineering Co., Ltd.). This was followed by kneading using a twin-screw kneader (Model PCM-30, Ikegai Corporation) set to a temperature of 125° C. The obtained kneaded material was cooled and coarsely pulverized to a diameter of 1 mm and below using a hammer mill to obtain a coarsely pulverized material. The resulting coarsely pulverized material was finely pulverized using a mechanical pulverizer (T-250, Freund-Turbo Corporation). Classification was then carried out using a rotational classifier (200TSP, Hosokawa Micron Corporation) to yield a toner particle. With regard to the operating conditions for the rotational classifier (200TSP, Hosokawa Micron Corporation), the classification was performed at a classification rotor rotation rate of 50.0 $s^{-1}$. The obtained toner particle had a weight-average particle diameter (D4) of 5.9 μm.

5.0 parts of inorganic fine particles 6 was added to 100 parts of the obtained toner particle, mixing was carried out using a Henschel mixer (Model FM-75, Nippon Coke & Engineering Co., Ltd.) at a rotation rate of 30 $s^{-1}$ and a rotation time of 5 minutes, and a heat treatment was performed using the surface treatment apparatus shown in the FIGURE. The operating conditions were as follows: feed rate=5 kg/hr, hot air current temperature=150° C., hot air current flow rate=6 $m^3$/min, cold air current temperature=5° C., cold air current flow rate=4 $m^3$/min, absolute moisture content of cold air current=3 g/$m^3$, blower air flow rate=20 $m^3$/min, and injection air flow rate=1 $m^3$/min.

A toner 1 was obtained by mixing 0.8 parts of hydrophobic silica fine particles that had a specific surface area of 90 $m^2/g$ and had been surface-treated with 20 mass % hexamethyldisilazane with 100 parts of the resulting treated toner particle using a Henschel mixer (Model FM-75, Nippon Coke & Engineering Co., Ltd.) at a rotation rate of 30 $s^{-1}$ for a rotation time of 10 minutes.

The resulting toner 1 had an average circularity of 0.960 and a weight-average particle diameter (D4) of 5.9 μm. The properties of the obtained toner 1 are given in Table 4-2.

The reference signs in the FIGURE are as follows: 101 starting material metering and feed means, 102 compressed gas adjustment means, 103 introduction tube, 104 projection member, 105 feed tube, 106 treatment compartment, 107 hot air current feed means, 108 cold air current feed means, 109 regulation means, 110 recovery means, 111 hot air current feed means outlet, 112 distribution member, 113 rotation member, 114 powder particle feed port.

Toners 2 to 14 and 26 to 35 Production Example

Toners 2 to 14 and toners 26 to 35 were obtained proceeding as in the Toner 1 Production Example, but changing the starting materials as shown in Table 4-1. The properties of the resulting toners are given in Table 4-2.

Toner 15 Production Example

| | |
|---|---|
| Amorphous polyester resin A2 | 70.0 parts |
| Amorphous polyester resin B | 30.0 parts |
| Crystalline polyester resin 1 | 2.0 parts |
| Fischer-Tropsch wax (Peak temperature of maximum endothermic peak = 78° C.) | 5.0 parts |
| Resin composition 1 | 5.0 parts |
| C.I. Pigment Blue 15:3 | 5.0 parts |
| Aluminum 3,5-di-t-butylsalicylate compound | 0.5 parts |

The starting materials listed in the preceding formulation were mixed at a rotation rate of 20 $s^{-1}$ for a rotation time of 5 minutes using a Henschel mixer (Model FM-75, Nippon Coke & Engineering Co., Ltd.). This was followed by kneading using a twin-screw kneader (Model PCM-30, Ikegai Corporation) set to a temperature of 125° C. The obtained kneaded material was cooled and coarsely pulverized to a diameter of 1 mm and below using a hammer mill to obtain a coarsely pulverized material. The resulting coarsely pulverized material was finely pulverized using a mechanical pulverizer (T-250, Freund-Turbo Corporation). Classification was then carried out using a rotational classifier (200TSP, Hosokawa Micron Corporation) to yield a toner particle. With regard to the operating conditions for the rotational classifier (200TSP, Hosokawa Micron Corporation), the classification was performed at a classification rotor rotation rate of 50.0 $s^{-1}$. The obtained toner particle had a weight-average particle diameter (D4) of 5.9 μm.

A toner 15 was obtained by mixing 5.0 parts of the inorganic fine particles 6 and 0.8 parts of hydrophobic silica fine particles, that had a specific surface area of 90 $m^2/g$ and had been surface-treated with 20 mass % hexamethyldisilazane, with 100 parts of the obtained toner particle using a Henschel mixer (Model FM-75, Nippon Coke & Engineering Co., Ltd.) at a rotation rate of 30 $s^{-1}$ for a rotation time of 30 minutes. The obtained toner 15 had an average circularity of 0.955 and a weight-average particle diameter (D4) of 5.9 μm. The properties of the obtained toner 15 are given in Table 4-2.

Toners 16 to 25 Production Example

Toners 16 to 25 were obtained proceeding as in the Toner 15 Production Example, but changing the raw materials as shown in Table 4-1. Behenyl behenate, a monofunctional ester wax, was used as the ester wax. The properties of the resulting toners are given in Table 4-2.

It could be confirmed for toners 1 to 35 that crystalline polyester domains were present dispersed in the toner cross section.

TABLE 4-1

| | Binder resin 1 | | Binder resin 2 | | | | Wax | | Resin | | |
|---|---|---|---|---|---|---|---|---|---|---|---|
| | Toner | Amorphous polyester resin A | | Amorphous polyester resin B | Crystalline polyester resin | | | Melting point | | composition 1 | Inorganic fine particles | |
| No. | No. | Parts | Parts | No. | Parts | Type | (° C.) | Parts | Parts | No. | Parts |
| 1 | A5 | 70.0 | 30.0 | 1 | 2.0 | f | 78 | 5.0 | 5.0 | 6 | 5.0 |
| 2 | A5 | 70.0 | 30.0 | 2 | 6.0 | f | 78 | 5.0 | 5.0 | 7 | 5.0 |
| 3 | A5 | 70.0 | 30.0 | 3 | 2.0 | f | 78 | 5.0 | 5.0 | 8 | 5.0 |
| 4 | A5 | 70.0 | 30.0 | 4 | 2.0 | f | 78 | 5.0 | 5.0 | 9 | 5.0 |
| 5 | A5 | 70.0 | 30.0 | 1 | 2.0 | f | 78 | 5.0 | 5.0 | 1 | 5.0 |
| 6 | A5 | 70.0 | 30.0 | 1 | 2.0 | f | 78 | 5.0 | 5.0 | 2 | 5.0 |
| 7 | A5 | 70.0 | 30.0 | 1 | 2.0 | f | 78 | 5.0 | 5.0 | 3 | 5.0 |
| 8 | A5 | 70.0 | 30.0 | 1 | 2.0 | f | 78 | 5.0 | 5.0 | 4 | 5.0 |
| 9 | A5 | 70.0 | 30.0 | 1 | 2.0 | f | 78 | 5.0 | 5.0 | 5 | 5.0 |
| 10 | A5 | 70.0 | 30.0 | 1 | 2.0 | f | 78 | 5.0 | 5.0 | 10 | 15.0 |
| 11 | A5 | 70.0 | 30.0 | 1 | 2.0 | f | 78 | 5.0 | 5.0 | 11 | 15.0 |
| 12 | A5 | 70.0 | 30.0 | 1 | 2.0 | f | 78 | 5.0 | 5.0 | 12 | 30.0 |
| 13 | A4 | 70.0 | 30.0 | 1 | 2.0 | f | 78 | 5.0 | 5.0 | 6 | 5.0 |
| 14 | A3 | 70.0 | 30.0 | 1 | 2.0 | f | 78 | 5.0 | 5.0 | 6 | 5.0 |
| 15 | A2 | 70.0 | 30.0 | 1 | 2.0 | f | 78 | 5.0 | 5.0 | 6 | 5.0 |
| 16 | A1 | 70.0 | 30.0 | 1 | 2.0 | f | 78 | 5.0 | 5.0 | 6 | 20.0 |
| 17 | A2 | 70.0 | 30.0 | 5 | 2.0 | f | 78 | 5.0 | 5.0 | 6 | 2.5 |
| 18 | A2 | 70.0 | 30.0 | 6 | 2.0 | f | 78 | 5.0 | 5.0 | 6 | 2.5 |
| 19 | A2 | 70.0 | 30.0 | 1 | 2.0 | f | 78 | 5.0 | — | 6 | 2.5 |
| 20 | A2 | 70.0 | 30.0 | 1 | 2.0 | f | 78 | 5.0 | 5.0 | 6 | 2.5 |
| 21 | A2 | 70.0 | 30.0 | 1 | 1.5 | f | 78 | 5.0 | 5.0 | 6 | 2.5 |
| 22 | A2 | 70.0 | 30.0 | 1 | 7.0 | f | 90 | 5.0 | 5.0 | 6 | 2.5 |
| 23 | A2 | 70.0 | 30.0 | 1 | 1.0 | f | 78 | 5.0 | 5.0 | 6 | 2.5 |

TABLE 4-1-continued

| Toner No. | Binder resin 1 Amorphous polyester resin A No. | Binder resin 1 Amorphous polyester resin A Parts | Binder resin 2 Amorphous polyester resin B Parts | Crystalline polyester resin No. | Crystalline polyester resin Parts | Wax Type | Wax Melting point (° C.) | Wax Parts | Resin composition 1 Parts | Inorganic fine particles No. | Inorganic fine particles Parts |
|---|---|---|---|---|---|---|---|---|---|---|---|
| 24 | A2 | 70.0 | 30.0 | 1 | 10.0 | f | 78 | 5.0 | 5.0 | 6 | 2.5 |
| 25 | A2 | 70.0 | 30.0 | 1 | 1.0 | e | 80 | 5.0 | 5.0 | 6 | 2.5 |
| 26 | A8 | 70.0 | 30.0 | 1 | 0.2 | f | 78 | 6.0 | 6.0 | 6 | 5.0 |
| 27 | A6 | 70.0 | 30.0 | 1 | 22.0 | f | 78 | 5.0 | 5.0 | 6 | 5.0 |
| 28 | A7 | 70.0 | 30.0 | 1 | 1.0 | f | 78 | 3.0 | 3.0 | 6 | 5.0 |
| 29 | A1 | 70.0 | 30.0 | 2 | 2.0 | f | 78 | 5.0 | 5.0 | 6 | 5.0 |
| 30 | A8 | 70.0 | 30.0 | 3 | 18.0 | f | 78 | 5.0 | 5.0 | 6 | 5.0 |
| 31 | A2 | 70.0 | 30.0 | 5 | 2.0 | f | 78 | 5.0 | 5.0 | 6 | 5.0 |
| 32 | A2 | 70.0 | 30.0 | 5 | 2.0 | f | 78 | 5.0 | 5.0 | 13 | 5.0 |
| 33 | A5 | 70.0 | 30.0 | 1 | 2.0 | f | 78 | 5.0 | 5.0 | — | — |
| 34 | A5 | 70.0 | 30.0 | 1 | 2.0 | f | 78 | 5.0 | 5.0 | 6 | 0.8 |
| 35 | A5 | 70.0 | 30.0 | 1 | 2.0 | f | 78 | 5.0 | 5.0 | 6 | 30.0 |

With regard to the types of wax in the table, "f" indicates a Fischer-Tropsch wax and "e" indicates an ester wax.

TABLE 4-2

| Toner No. | Toner properties: CPES occupied area (%) | CPES domain diameter (nm) | CPES aspect ratio | T2w − T2c | H2w/H2c | Coverage ratio by inorganic fine particles (%) | fixing ratio for inorganic fine particles (%) |
|---|---|---|---|---|---|---|---|
| 1 | 50.0 | 350 | 3 | 12.0 | 3.0 | 12 | 90 |
| 2 | 50.0 | 350 | 3 | 12.0 | 1.0 | 12 | 90 |
| 3 | 50.0 | 350 | 3 | 12.0 | 3.0 | 12 | 90 |
| 4 | 50.0 | 350 | 3 | 12.0 | 3.0 | 12 | 90 |
| 5 | 50.0 | 350 | 3 | 12.0 | 3.0 | 12 | 90 |
| 6 | 50.0 | 350 | 3 | 12.0 | 3.0 | 12 | 90 |
| 7 | 50.0 | 350 | 3 | 12.0 | 3.0 | 12 | 90 |
| 8 | 50.0 | 350 | 3 | 12.0 | 3.0 | 12 | 90 |
| 9 | 50.0 | 350 | 3 | 12.0 | 3.0 | 12 | 90 |
| 10 | 50.0 | 350 | 3 | 12.0 | 3.0 | 12 | 90 |
| 11 | 50.0 | 350 | 3 | 12.0 | 3.0 | 12 | 90 |
| 12 | 50.0 | 350 | 3 | 12.0 | 3.0 | 12 | 90 |
| 13 | 50.0 | 350 | 3 | 12.0 | 3.0 | 12 | 90 |
| 14 | 50.0 | 350 | 3 | 7.2 | 3.0 | 12 | 90 |
| 15 | 50.0 | 350 | 3 | 6.3 | 3.0 | 12 | 15 |
| 16 | 50.0 | 350 | 3 | 5.1 | 3.0 | 55 | 15 |
| 17 | 50.0 | 350 | 3 | 4.5 | 3.0 | 6 | 15 |
| 18 | 50.0 | 350 | 3 | 4.3 | 3.0 | 6 | 15 |
| 19 | 50.0 | 350 | 3 | 6.3 | 3.0 | 6 | 15 |
| 20 | 50.0 | 350 | 3 | 6.3 | 3.0 | 6 | 15 |
| 21 | 50.0 | 250 | 3 | 6.3 | 3.0 | 6 | 15 |
| 22 | 50.0 | 550 | 3 | 7.8 | 0.7 | 6 | 15 |
| 23 | 50.0 | 150 | 3 | 6.3 | 3.3 | 6 | 15 |
| 24 | 50.0 | 800 | 3 | 6.3 | 0.5 | 6 | 15 |
| 25 | 50.0 | 150 | 3 | 6.3 | 3.3 | 6 | 15 |
| 26 | 50.0 | 120 | 3 | 11.0 | 7.0 | 12 | 90 |
| 27 | 50.0 | 960 | 3 | 11.2 | 5.0 | 12 | 90 |
| 28 | 5.0 | 350 | 3 | 12.5 | 2.5 | 12 | 90 |
| 29 | 50.0 | 100 | 3 | 12.0 | 1.8 | 12 | 90 |
| 30 | 50.0 | 1200 | 3 | 12.0 | 7.8 | 12 | 90 |
| 31 | 50.0 | 350 | 5 | 11.4 | 1.0 | 12 | 90 |
| 32 | 50.0 | 350 | 3 | 11.4 | 1.0 | 12 | 90 |
| 33 | 50.0 | 350 | 3 | 12.0 | 3.0 | — | 90 |
| 34 | 50.0 | 350 | 3 | 12.0 | 3.0 | 3 | 90 |
| 35 | 50.0 | 350 | 3 | 12.0 | 3.0 | 65 | 90 |

In the table, the "CPES occupied area" refers to (DB/DA×100(%)) (the percentage, with reference to the total of the area occupied by the crystalline polyester domains in the total area of the toner cross section, for the area occupied by the crystalline polyester domains in the region to a depth of 0.50 μm from the toner particle contour).

"CPES domain diameter" refers to the number-average value of the length of the major axis of the crystalline polyester domains.

"CPES aspect ratio" refers to the number average value of the aspect ratio of the crystalline polyester domains.

Carrier Production Example

Magnetic Core Particle 1 Production Example

Step 1 (Weighing and Mixing Step):

| | |
|---|---|
| $Fe_2O_3$ | 62.7 mass parts |
| $MnCO_3$ | 29.5 mass parts |
| $Mg(OH)_2$ | 6.8 mass parts |
| $SrCO_3$ | 1.0 mass parts |

This ferrite starting material was weighed out to provide the indicated compositional ratio for the materials. This was followed by pulverization and mixing for 5 hours with a dry vibrating mill that used stainless steel beads having a diameter of ⅛-inch.

Step 2 (Prefiring Step):

The obtained pulverized material was converted into approximately 1 mm-square pellets using a roller compactor. Coarse powder was removed from these pellets using a vibrating screen having an aperture of 3 mm; the fines were then removed using a vibrating screen having an aperture of 0.5 mm; and firing was thereafter carried out in a burner-type firing furnace under a nitrogen atmosphere (0.01 volume % oxygen concentration) for 4 hours at a temperature of 1,000° C. to produce a prefired ferrite. The composition of the obtained prefired ferrite is as follows.

$$(MnO)_a(MgO)_b(SrO)_c(Fe_2O_3)_d$$

In the formula, a=0.257, b=0.117, c=0.007, d=0.393.

Step 3 (Pulverization Step):

The obtained prefired ferrite was pulverized with a crusher to about 0.3 mm, followed by the addition of 30 parts of water per 100 parts of the prefired ferrite and pulverization for 1 hour with a wet ball mill using zirconia beads with a diameter of ⅛ inch. The obtained slurry was pulverized for 4 hours with a wet ball mill using alumina beads having a diameter of 1/16 inch to obtain a ferrite slurry (fine pulverizate of the prefired ferrite).

Step 4 (Granulating Step):

1.0 parts of an ammonium polycarboxylate as a dispersing agent and 2.0 parts of polyvinyl alcohol as a binder were added to the ferrite slurry per 100 parts of the prefired ferrite, followed by granulation into spherical particles using a spray dryer (manufacturer: Ohkawara Kakohki Co., Ltd.). The particle size of the obtained particles was adjusted followed by heating for 2 hours at 650° C. using a rotary kiln to remove the organic component, e.g., the dispersing agent and binder.

Step 5 (Firing Step):

In order to control the firing atmosphere, the temperature was raised over 2 hours using an electric furnace from room temperature to a temperature of 1,300° C. under a nitrogen atmosphere (1.00 volume % oxygen concentration), and firing was then performed for 4 hours at a temperature of 1,150° C. This was followed by reducing the temperature to a temperature of 60° C. over 4 hours, returning to the atmosphere from the nitrogen atmosphere, and removal at a temperature of 40° C. or below.

Step 6 (Classification Step):

The aggregated particles were broken up; the low magnetic force product was then removed using a magnetic force classifier; and the coarse particles were removed by sieving on a sieve with an aperture of 250 μm to obtain magnetic core particle 1 having a 50% particle diameter (D50) on a volume basis of 37.0 μm.

Coating Resin 1 Preparation

| | |
|---|---|
| Cyclohexyl methacrylate monomer | 26.8 mass % |
| Methyl methacrylate monomer | 0.2 mass % |
| Methyl methacrylate macromonomer (Macromonomer having the methacryloyl group at one terminal and having a weight-average molecular weight of 5,000) | 8.4 mass % |
| Toluene | 31.3 mass % |
| Ethyl methyl ketone | 31.3 mass % |
| Azobisisobutyronitrile | 2.0 mass % |

Of these materials, the cyclohexyl methacrylate, methyl methacrylate, methyl methacrylate macromonomer, toluene, and ethyl methyl ketone were introduced into a four-neck separable flask fitted with a reflux condenser, thermometer, nitrogen introduction line, and stirrer and nitrogen gas was introduced to thoroughly establish a nitrogen atmosphere. This was followed by heating to 80° C., the addition of the azobisisobutyronitrile, and polymerization for 5 hours under reflux. Hexane was poured into the resulting reaction product to precipitate the copolymer, and the precipitate was separated by filtration and vacuum dried to obtain a coating resin 1. 30 parts of the obtained coating resin 1 was then dissolved in 40 parts of toluene and 30 parts of ethyl methyl ketone to obtain a polymer solution 1 (solids fraction=30 mass %).

Coating Resin Solution 1 Preparation

| | |
|---|---|
| Polymer solution 1 (Resin solids fraction concentration = 30%) | 33.3 mass % |
| Toluene | 66.4 mass % |
| Carbon black (Regal 330, Cabot Corporation) | 0.3 mass % |

(Primary particle diameter=25 nm, Specific surface area by nitrogen adsorption=94 $m^2/g$, DBP absorption=75 mL/100 g) were dispersed for 1 hour with a paint shaker using zirconia beads having a diameter of 0.5 mm. The obtained dispersion was filtered across a 5.0 μm membrane filter to obtain coating resin solution 1.

Magnetic Carrier 1 Production Example

Resin Coating Step:

100 Parts of the magnetic core particle 1 and 2.5 parts, as the resin component, of the coating resin solution 1 were introduced into a vacuum-degassing kneader being maintained at normal temperature. After the introduction, stirring was performed for 15 minutes at a stirring rate of 30 rpm and the solvent was evaporated by at least a prescribed amount (80 mass %), followed by raising the temperature to 80° C. while mixing under reduced pressure, distilling off the toluene over 2 hours, and cooling. The low magnetic force product was separated from the resulting magnetic carrier using a magnetic force classifier, and the magnetic carrier was then passed through a sieve having an aperture of 70 μm and classified using a wind force classifier to obtain a magnetic carrier 1 having a 50% particle diameter (D50) on a volume basis of 38.2 μm.

Two-Component Developer 1 Production Example 8.0 parts of toner 1 was added to 92.0 parts of magnetic carrier 1 and a two-component developer 1 was obtained by mixing with a V-mixer (V-20, Seishin Enterprise Co., Ltd.).

Two-Component Developers 2 to 35 Production Example

Two-component developers 2 to 35 were produced by carrying out the same procedure as in the Two-Component Developer 1 Production Example, but changing the toner as indicated in Table 5.

TABLE 5

| | Toner | Carrier | Two-component developer |
|---|---|---|---|
| Example 1 | Toner 1 | Carrier 1 | Two-component developer 1 |
| Example 2 | Toner 2 | Carrier 1 | Two-component developer 2 |
| Example 3 | Toner 3 | Carrier 1 | Two-component developer 3 |
| Example 4 | Toner 4 | Carrier 1 | Two-component developer 4 |
| Example 5 | Toner 5 | Carrier 1 | Two-component developer 5 |
| Example 6 | Toner 6 | Carrier 1 | Two-component developer 6 |
| Example 7 | Toner 7 | Carrier 1 | Two-component developer 7 |
| Example 8 | Toner 8 | Carrier 1 | Two-component developer 8 |
| Example 9 | Toner 9 | Carrier 1 | Two-component developer 9 |
| Example 10 | Toner 10 | Carrier 1 | Two-component developer 10 |
| Example 11 | Toner 11 | Carrier 1 | Two-component developer 11 |
| Example 12 | Toner 12 | Carrier 1 | Two-component developer 12 |
| Example 13 | Toner 13 | Carrier 1 | Two-component developer 13 |
| Example 14 | Toner 14 | Carrier 1 | Two-component developer 14 |
| Example 15 | Toner 15 | Carrier 1 | Two-component developer 15 |
| Example 16 | Toner 16 | Carrier 1 | Two-component developer 16 |
| Example 17 | Toner 17 | Carrier 1 | Two-component developer 17 |
| Example 18 | Toner 18 | Carrier 1 | Two-component developer 18 |
| Example 19 | Toner 19 | Carrier 1 | Two-component developer 19 |
| Example 20 | Toner 20 | Carrier 1 | Two-component developer 20 |
| Example 21 | Toner 21 | Carrier 1 | Two-component developer 21 |
| Example 22 | Toner 22 | Carrier 1 | Two-component developer 22 |
| Example 23 | Toner 23 | Carrier 1 | Two-component developer 23 |
| Example 24 | Toner 24 | Carrier 1 | Two-component developer 24 |
| Example 25 | Toner 25 | Carrier 1 | Two-component developer 25 |
| Comparative Example 1 | Toner 26 | Carrier 1 | Two-component developer 26 |
| Comparative Example 2 | Toner 27 | Carrier 1 | Two-component developer 27 |
| Comparative Example 3 | Toner 28 | Carrier 1 | Two-component developer 28 |
| Comparative Example 4 | Toner 29 | Carrier 1 | Two-component developer 29 |
| Comparative Example 5 | Toner 30 | Carrier 1 | Two-component developer 30 |
| Comparative Example 6 | Toner 31 | Carrier 1 | Two-component developer 31 |
| Comparative Example 7 | Toner 32 | Carrier 1 | Two-component developer 32 |
| Comparative Example 8 | Toner 33 | Carrier 1 | Two-component developer 33 |
| Comparative Example 9 | Toner 34 | Carrier 1 | Two-component developer 34 |
| Comparative Example 10 | Toner 35 | Carrier 1 | Two-component developer 35 |

Method for Evaluating the Low-Temperature Fixability

The low-temperature fixability was evaluated using an imagePress C10000VP full-color copier from Canon, Inc. as the image-forming apparatus.

An unfixed image was output by a modified machine provided by removing the fixing unit from this copier.

The fixing test was carried out using the fixing unit which had been removed from the copier, and which had been modified to enable the fixation temperature to be adjusted. The specific evaluation method is as follows.

Paper: OK Top128 (128 g/m$^2$)

Toner laid-on level: 1.20 mg/cm$^2$

Fixing test environment: low-temperature, low-humidity environment (15° C./10% RH)

After the unfixed image had been produced, the low-temperature fixability was evaluated with the process speed set to 450 mm/s and the fixation temperature set to 130° C. The value of the percentage reduction in the image density was used as the index for evaluation of the low-temperature fixability. For the percentage reduction in image density, the image density at the center was first measured using an X-Rite color reflection densitometer (500 Series, X-Rite, Incorporated). Operating on the region where the image density had been measured, the fixed image was rubbed (5 back-and-forth excursions) with lens-cleaning paper while applying a load of 4.9 kPa (50 g/cm$^2$) and the image density was remeasured. The percentage decline (%) in the image density pre-versus-post-rubbing was determined. A score of D or better was regarded as good.

Evaluation Criteria

A: The percentage reduction in density is less than 1.0%.

B: The percentage reduction in density is at least 1.0%, but less than 5.0%.

C: The percentage reduction in density is at least 5.0%, but less than 10.0%.

D: The percentage reduction in density is at least 10.0%, but less than 15.0%.

E: The percentage reduction in density is at least 15.0%.

Method for Evaluating the Releasability During Fixing

Using the modified copier as described above, a full-surface solid image having a toner laid-on level of 0.60 mg/cm$^2$ and a 3.0 mm margin at the upper edge was produced without fixing.

This unfixed image was then fixed using the modified fixing unit at a process speed of 450 mm/sec.

To evaluate the releasability during fixing, the fixation temperature was reduced from 200° C. in 5° C. steps, and the fixing lower limit temperature was taken to be the temperature provided by adding 5° C. to the temperature at which wraparound was produced. The test environment was a high-temperature, high-humidity environment (30° C./80% RH).

A4 CS-680 paper (60 g/m$^2$ from Canon, Inc.) was used for the transfer material for the fixed image. The evaluation criteria are as follows. A score of D or better was regarded as good.

Evaluation Criteria

A: The fixing lower limit temperature is less than 150° C.

B: The fixing lower limit temperature is at least 150° C., but less than 160° C.

C: The fixing lower limit temperature is at least 160° C., but less than 170° C.

D: The fixing lower limit temperature is at least 170° C., but less than 180° C.

E: The fixing lower limit temperature is at least 180° C.

Method for Evaluating Color Variation after Durability Testing

The evaluation was performed using an imagePress C10000VP full-color copier from Canon, Inc. as the image-forming apparatus and with two-component developer 1 introduced into the cyan station developing device. The evaluation environment was a high-temperature, high-humidity environment (30° C./80% RH), and GFC-081 general-purpose copy paper (A4, areal weight=81.4 g/m$^2$, acquired from Canon Marketing Japan Inc.) was used for the evaluation paper.

Operating with a high print percentage (image print percentage=30%) or a low print percentage (image print percentage=1%), in each case a 50000-print durability test was run and the percentage density change was evaluated by measuring the difference between the initial density (first print in the durability test) and the density after the durability test (50000th print).

The image density was evaluated according to the evaluation criteria given below using an X-Rite color reflection densitometer (500 Series, X-Rite, Incorporated). The results of the evaluation are given in Table 6. A score of D or better was regarded as good.

Evaluation Criteria

A: The percentage change in density is less than 0.5%.

B: The percentage change in density is at least 0.5%, but less than 1.0%.

C: The percentage change in density is at least 1.0%, but less than 2.0%.

D: The percentage change in density is at least 2.0%, but less than 3.0%.

E: The percentage change in density is at least 3.0%.

Method for Evaluating Fogging in Nonimage Areas

The evaluation was performed using an imagePress C10000VP full-color copier from Canon, Inc. as the image-forming apparatus and with two-component developer 1 introduced into the cyan station developing device.

The evaluation environment was a high-temperature, high-humidity environment (30° C./80% RH), and GFC-081 general-purpose copy paper (A4, areal weight=81.4 g/m$^2$, acquired from Canon Marketing Japan Inc.) was used for the evaluation paper.

A 50000-print durability test was carried out using a 20% print percentage image, and the fogging in a white background area was measured before and after the durability test.

The average reflectance Dr (%) of the evaluation paper prior to image output was measured using a reflectometer ("Reflectometer Model TC-6DS", from Tokyo Denshoku Co., Ltd.).

The reflectance Ds (%) was measured in a OOH image area (white background area) both at the start (1st print) and after the durability test (50000th print). The values provided by subtracting Dr from Ds at the start (1st print) and after the durability test (50,000th print) were used for the fogging (%), and these were evaluated using the following criteria.

The results of the evaluation are given in Table 6. A score of D or better was regarded as good.

Evaluation Criteria

A: Less than 0.5%

B: At least 0.5%, but less than 1.0%

C: At least 1.0%, but less than 2.0%

D: At least 2.0%, but less than 3.0%

E: At least 3.0%

Examples 1 to 25 and Comparative Examples 1 to 10

The above evaluations were performed using two-component developer 1 to 35. The results are shown in Table 6.

TABLE 6

| | | | Color variation (percentage density change) | | Fogging in nonimage area | |
|---|---|---|---|---|---|---|
| | Low-temperature fixability | Releasability during fixing | After durability testing at 30% duty | After durability testing at 1% duty | Start | After durability test |
| Example 1 | A | A | A | A | A | A |
| Example 2 | A | B | A | A | A | A |
| Example 3 | A | A | A | A | A | A |
| Example 4 | A | A | A | A | A | A |
| Example 5 | A | A | A | B | A | A |
| Example 6 | A | A | A | B | A | A |
| Example 7 | A | A | A | B | A | B |
| Example 8 | A | A | A | B | A | B |
| Example 9 | A | A | A | A | A | B |
| Example 10 | B | A | A | B | A | B |
| Example 11 | B | A | A | B | A | B |
| Example 12 | B | A | B | B | B | B |
| Example 13 | B | B | A | A | A | A |
| Example 14 | B | C | A | A | A | A |
| Example 15 | B | C | B | B | B | B |
| Example 16 | C | C | A | B | A | B |
| Example 17 | C | D | B | C | B | C |
| Example 18 | C | D | B | C | B | C |
| Example 19 | C | D | B | C | B | C |
| Example 20 | C | C | B | C | B | C |
| Example 21 | C | D | B | C | B | C |
| Example 22 | D | C | B | C | B | C |
| Example 23 | C | D | C | C | C | C |
| Example 24 | D | C | C | C | C | C |
| Example 25 | C | D | C | C | C | C |
| Comparative Example 1 | D | E | B | B | B | B |
| Comparative Example 2 | E | D | B | C | C | D |
| Comparative Example 3 | D | E | C | C | C | C |
| Comparative Example 4 | C | E | B | B | B | B |
| Comparative Example 5 | E | C | D | D | D | D |
| Comparative Example 6 | B | D | D | E | C | D |
| Comparative Example 7 | B | B | D | E | D | D |
| Comparative Example 8 | B | B | E | E | E | E |
| Comparative Example 9 | B | B | D | E | D | E |
| Comparative Example 10 | E | E | B | B | B | B |

Duty indicates the print percentage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-228294, filed Dec. 5, 2018, which is hereby incorporated by reference herein in its entirety.

What is claimed is:

1. A toner comprising:

toner particles, each of the toner particles includes a binder resin and a crystalline polyester, a content of the crystalline polyester being 0.5 to 20.0 mass parts per 100 mass parts of the binder resin; and strontium titanate particles present on a surface of each of the toner particles, wherein in a cross section of each of the toner particles the crystalline polyester is observed as domains, a percentage ratio of DB to DA is 10% or more where DA is a sum of areas of all the domains in said cross section of each of the toner particles, and DB is a sum of areas of the domains in said cross section of each of the toner particles present in a region surrounded by a contour of each of the toner particles and a line apart from the contour by 0.50 μm towards inside of each of the toner particles, and with respect to the domains present in the region, the number average of lengths of a major axis of the domains is 120 to 1000 nm and the number average of aspect ratios of the domains is not more than 4, a dielectric constant of the strontium titanate particles is 25 to 300 pF/m measured at 25° C. and 1 MHz, and a coverage ratio by the strontium titanate particles on the surface of each of the toner particles is 8 to 60%.

2. The toner according to claim 1, wherein the crystalline polyester is a polycondensate of a diol component that contains as a major component thereof an aliphatic diol having 6 to 16 carbons, and a dicarboxylic acid component that contains as a major component thereof an aliphatic dicarboxylic acid having 6 to 16 carbons.

3. The toner according to claim 1, wherein the fixing ratio of the strontium titanate particles on the surface of each of the toner particles is 20 to 100%.

4. The toner according to claim 1, wherein the toner particle contains a wax, and when performing differential scanning calorimetry of the toner using a step I of heating from 20° C. to 180° C. at a ramp rate of 10° C./min, and then a step II of cooling to 20° C. at a cooling rate of 10° C./min $T2w-T2c \leq 8.0$ and $0.8 \leq H2w/H2c \leq 8.0$ where T2w (° C.) is the peak temperature and H2w (J/g) is the exothermic quantity of a peak originating with the wax measured in step II, and T2c (° C.) is the peak temperature and H2c (J/g) is the exothermic quantity originating with the crystalline polyester measured in step II.

5. The toner according to claim 1, wherein the binder resin includes an amorphous polyester that includes an alcohol unit and a carboxylic acid unit, and the percentage for alcohol unit derived from a bisphenol A ethylene oxide adduct is at least 30 mass % with reference to the total of the overall alcohol unit.

6. The toner according to claim 5, wherein the strontium titanate particle has a rectangular parallelepiped particle shape and a perovskite crystal structure.

7. The toner according to claim 1, which contains a resin composition provided by the reaction of a styrene-acrylic resin with a polyolefin.

8. The toner according to claim 1, which is a heat-treated toner.

9. The toner according to claim 1, wherein the coverage ratio of the strontium titanate particles on the surface of each of the toner particles is 12 to 60%.

10. The toner according to claim 1, wherein the coverage ratio of the strontium titanate particles on the surface of each of the toner particles is 12 to 55%.

* * * * *